US006869364B2

(12) United States Patent
DeWeese et al.

(10) Patent No.: US 6,869,364 B2
(45) **Date of Patent: *Mar. 22, 2005**

(54) INTERACTIVE WAGERING SYSTEMS AND METHODS WITH MULTIPLE TELEVISION FEEDS

(75) Inventors: Toby DeWeese, Tulsa, OK (US); Masood Garahi, Superior, CO (US); William L. Thomas, Bixby, OK (US)

(73) Assignee: ODS Properties, Inc., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/409,188

(22) Filed: Apr. 7, 2003

(65) Prior Publication Data

US 2003/0195038 A1 Oct. 16, 2003

Related U.S. Application Data

(63) Continuation of application No. 09/826,531, filed on Apr. 4, 2001, now Pat. No. 6,544,121.
(60) Provisional application No. 60/194,803, filed on Apr. 5, 2000.

(51) Int. Cl.[7] ..... A63F 9/24
(52) U.S. Cl. ..... 463/30; 463/40; 348/7; 348/460
(58) Field of Search ..... 463/30, 31, 40–42; 348/7, 460, 143, 157, 159; 700/91, 92, 93; 725/73, 153

(56) References Cited

U.S. PATENT DOCUMENTS

| | | | | |
|---|---|---|---|---|
| 3,909,002 A | 9/1975 | Levy | 273/138 A |
| 4,033,588 A | 7/1977 | Watts | 273/138 A |
| 4,108,361 A | 8/1978 | Krause | 235/375 |
| 4,322,612 A | 3/1982 | Lange | 235/419 |
| 4,339,798 A | 7/1982 | Hedges et al. | 364/412 |
| 4,372,558 A | 2/1983 | Shimamoto et al. | 273/238 |
| 4,494,197 A | 1/1985 | Troy et al. | 364/412 |
| 4,593,904 A | 6/1986 | Graves | 273/1 E |
| 4,636,951 A | 1/1987 | Harlick | 364/412 |
| 4,652,998 A | 3/1987 | Koza et al. | 364/412 |
| 4,689,742 A | 8/1987 | Troy et al. | 364/412 |
| 4,694,490 A | 9/1987 | Harvey et al. | 380/20 |
| 4,704,725 A | 11/1987 | Harvey et al. | 380/9 |
| 4,706,121 A | 11/1987 | Young | 358/142 |
| 4,745,468 A | 5/1988 | Von Kohorn | 358/84 |
| 4,747,600 A | 5/1988 | Richardson | 273/269 |

(List continued on next page.)

FOREIGN PATENT DOCUMENTS

| | | | |
|---|---|---|---|
| EP | 0 387 046 A2 | 9/1990 | G07F/7/02 |
| EP | 0 583 196 A1 | 2/1994 | H04N/7/173 |
| EP | 0 620 688 A2 | 10/1994 | H04N/7/14 |

(List continued on next page.)

OTHER PUBLICATIONS

US 5,823,877, 10/1998, Scagnelli et al. (withdrawn)
You Bet Help File, Youbet.com, Inc., Los Angeles, California, last modified Jul. 11, 1998, pp. 1–132.

(List continued on next page.)

*Primary Examiner*—Michael O'Neill
(74) *Attorney, Agent, or Firm*—Fish & Neave LLP

(57) ABSTRACT

Interactive wagering systems and methods with multiple television feeds are provided. A plurality of television feeds may be related to a race and race-related characteristics. A television feed may carry television feed information, which may provide sufficient information to allow a user to select an appropriate television feed for a wager or to allow the system to automatically select an appropriate feed for a wager. The interactive wagering application may also record a television feed so that the user may interact with the television feeds at any time. Wagering services may be also provided to a user through more than one wagering interface.

64 Claims, 28 Drawing Sheets

U.S. PATENT DOCUMENTS

| | | | | |
|---|---|---|---|---|
| 4,760,527 | A | 7/1988 | Sidley | 364/412 |
| 4,764,666 | A | 8/1988 | Bergeron | 235/380 |
| 4,799,683 | A | 1/1989 | Bruner, Jr. | 273/138 A |
| 4,815,741 | A | 3/1989 | Small | 273/138 A |
| 4,882,473 | A | 11/1989 | Bergeron et al. | 235/380 |
| 4,922,522 | A | 5/1990 | Scanlon | 379/95 |
| 4,926,255 | A | 5/1990 | Von Kohorn | 358/84 |
| 4,926,327 | A | 5/1990 | Sidley | 364/412 |
| 4,965,825 | A | 10/1990 | Harvey et al. | 380/9 |
| 4,969,183 | A | 11/1990 | Reese | 379/88 |
| 4,972,494 | A | 11/1990 | White et al. | 382/8 |
| 4,992,866 | A | 2/1991 | Morgan | 358/108 |
| 4,996,705 | A | 2/1991 | Entenmann et al. | 379/91 |
| 5,007,649 | A | 4/1991 | Richardson | 273/237 |
| 5,034,807 | A | 7/1991 | Von Kohorn | 358/84 |
| 5,054,787 | A | 10/1991 | Richardson | 273/369 |
| 5,057,915 | A | 10/1991 | Von Kohorn | 358/84 |
| 5,068,733 | A | 11/1991 | Bennett | 358/181 |
| 5,083,271 | A | 1/1992 | Thacher et al. | 364/411 |
| 5,083,272 | A | 1/1992 | Walker et al. | 364/412 |
| 5,083,800 | A | 1/1992 | Lockton | 273/439 |
| 5,096,195 | A | 3/1992 | Gimmon | 273/138 |
| 5,096,202 | A | 3/1992 | Hesland | 273/237 |
| 5,112,050 | A | 5/1992 | Koza et al. | 273/139 |
| 5,119,295 | A | 6/1992 | Kapur | 364/412 |
| 5,178,389 | A | 1/1993 | Bentley et al. | 273/138 |
| 5,181,107 | A | 1/1993 | Rhoades | 358/86 |
| 5,186,471 | A | 2/1993 | Vancraeynest | 273/439 |
| 5,218,631 | A | 6/1993 | Katz | 379/88 |
| 5,227,874 | A | 7/1993 | Von Kohorn | 358/84 |
| 5,233,654 | A | 8/1993 | Harvey et al. | 380/20 |
| 5,249,044 | A | 9/1993 | Von Kohorn | 358/86 |
| 5,276,312 | A | 1/1994 | McCarthy | 235/380 |
| 5,280,426 | A | 1/1994 | Edmonds | 364/408 |
| 5,282,620 | A | 2/1994 | Keesee | 273/138 |
| 5,283,734 | A | 2/1994 | Von Kohorn | 364/412 |
| 5,286,023 | A | 2/1994 | Wood | 273/138 |
| 5,297,802 | A | 3/1994 | Pocock et al. | 273/439 |
| 5,326,104 | A | 7/1994 | Pease et al. | 273/138 |
| 5,327,485 | A | 7/1994 | Leaden | 379/95 |
| 5,333,868 | A | 8/1994 | Goldfarb | 273/138 |
| 5,340,119 | A | 8/1994 | Goldfarb | 273/439 |
| 5,351,970 | A | 10/1994 | Fioretti | 273/439 |
| 5,354,069 | A | 10/1994 | Guttman et al. | 273/439 |
| 5,365,575 | A | 11/1994 | Katz | 379/92 |
| 5,398,932 | A | 3/1995 | Eberhardt et al. | 273/138 |
| 5,403,999 | A | 4/1995 | Entenmann et al. | 235/379 |
| 5,408,417 | A | 4/1995 | Wilder | 364/479 |
| 5,415,416 | A | 5/1995 | Scagnelli et al. | 273/439 |
| 5,417,424 | A | 5/1995 | Snowden et al. | 273/138 |
| 5,448,291 | A | 9/1995 | Wickline | 348/159 |
| 5,488,412 | A | 1/1996 | Majeti et al. | 348/10 |
| 5,505,449 | A | 4/1996 | Eberhardt et al. | 273/138 |
| 5,507,489 | A | 4/1996 | Reibel et al. | 273/138 |
| 5,518,253 | A | 5/1996 | Pocock et al. | 273/439 |
| 5,539,450 | A | 7/1996 | Handelman | 348/12 |
| 5,539,822 | A | 7/1996 | Lett | 380/20 |
| 5,545,088 | A | 8/1996 | Kravitz et al. | 463/40 |
| 5,564,977 | A | 10/1996 | Algie | 463/25 |
| 5,569,083 | A | 10/1996 | Fioretti | 463/19 |
| 5,573,244 | A | 11/1996 | Mindes | 463/26 |
| 5,575,474 | A | 11/1996 | Rossides | 463/26 |
| 5,577,727 | A | 11/1996 | Brame et al. | 273/139 |
| 5,577,735 | A | 11/1996 | Reed et al. | 273/439 |
| 5,586,937 | A | 12/1996 | Menashe | 463/41 |
| 5,592,212 | A | 1/1997 | Handelman | 348/12 |
| 5,600,368 | A | 2/1997 | Matthews, III | 348/143 |
| 5,608,785 | A | 3/1997 | Kasday | 379/90 |
| 5,643,088 | A | 7/1997 | Vaughn et al. | 463/40 |
| 5,647,795 | A | 7/1997 | Stanton | 463/1 |
| 5,679,077 | A | 10/1997 | Pocock et al. | 463/19 |
| 5,683,090 | A | 11/1997 | Zeile et al. | 273/269 |
| 5,688,174 | A | 11/1997 | Kennedy | 463/37 |
| 5,713,795 | A | 2/1998 | Kohorn | 463/17 |
| 5,722,890 | A | 3/1998 | Libby et al. | 463/17 |
| 5,729,212 | A | 3/1998 | Martin | 340/870.28 |
| 5,746,657 | A | 5/1998 | Ueno | 463/41 |
| 5,749,785 | A | 5/1998 | Rossides | 463/25 |
| 5,755,621 | A | 5/1998 | Marks et al. | 463/42 |
| 5,759,101 | A | 6/1998 | Von Kohorn | 463/40 |
| 5,762,552 | A | 6/1998 | Vuong et al. | 463/25 |
| 5,772,511 | A | 6/1998 | Smeltzer | 463/17 |
| 5,787,156 | A | 7/1998 | Katz | 379/93.13 |
| 5,800,268 | A | 9/1998 | Molnick | 463/40 |
| 5,816,917 | A | 10/1998 | Kelmer et al. | 463/16 |
| 5,816,919 | A | 10/1998 | Scagnelli et al. | 463/25 |
| 5,823,879 | A | 10/1998 | Goldberg et al. | 463/42 |
| 5,830,067 | A | 11/1998 | Graves et al. | 463/40 |
| 5,830,068 | A | 11/1998 | Brenner et al. | 463/42 |
| 5,830,069 | A | 11/1998 | Soltesz et al. | 463/42 |
| 5,871,398 | A | 2/1999 | Schneier et al. | 463/16 |
| 5,910,047 | A | 6/1999 | Scagnelli et al. | 463/17 |
| 5,954,582 | A | 9/1999 | Zach | 463/25 |
| 5,982,412 | A | 11/1999 | Nulty | 348/6 |
| 5,999,808 | A | 12/1999 | LaDue | 455/412 |
| 6,001,016 | A | 12/1999 | Walker et al. | 463/42 |
| 6,007,426 | A | 12/1999 | Kelly et al. | 463/16 |
| 6,024,640 | A | 2/2000 | Walker et al. | 463/17 |
| 6,024,641 | A | 2/2000 | Sarno | 463/17 |
| 6,030,288 | A | 2/2000 | Davis et al. | 463/29 |
| 6,080,062 | A | 6/2000 | Olson | 463/42 |
| 6,080,063 | A | 6/2000 | Khosla | 463/42 |
| 6,084,638 | A | 7/2000 | Hare et al. | 348/552 |
| 6,099,408 | A | 8/2000 | Schneier et al. | 463/29 |
| 6,102,797 | A | 8/2000 | Kail | 463/16 |
| 6,117,011 | A | 9/2000 | Lvov | 463/25 |
| 6,117,013 | A | 9/2000 | Eiba | 463/41 |
| 6,152,824 | A | 11/2000 | Rothschild et al. | 463/42 |
| 6,172,673 | B1 | 1/2001 | Lehtinen et al. | 345/327 |
| 6,186,892 | B1 | 2/2001 | Frank et al. | 463/19 |
| 6,203,427 | B1 | 3/2001 | Walker et al. | 463/16 |
| 6,251,016 | B1 | 6/2001 | Tsuda et al. | 463/42 |
| 6,251,017 | B1 | 6/2001 | Leason et al. | 463/42 |
| 6,254,480 | B1 | 7/2001 | Zach | 463/17 |
| 6,257,982 | B1 | 7/2001 | Rider et al. | 463/31 |
| 6,263,054 | B1 | 7/2001 | Haefliger | 379/93.13 |
| 6,264,560 | B1 | 7/2001 | Goldberg et al. | 463/42 |
| 6,272,223 | B1 | 8/2001 | Carlson | 380/251 |
| 6,273,820 | B1 | 8/2001 | Haste, III | 463/40 |
| 6,312,336 | B1 | 11/2001 | Handelman et al. | 463/40 |
| 6,383,148 | B1 | 5/2002 | Pusch et al. | 600/587 |
| 6,532,495 | B1 | 3/2003 | Welles, II et al. | 709/232 |
| 6,579,184 | B1 | 6/2003 | Tanskanen | 463/41 |
| 2001/0003099 | A1 | 6/2001 | Von Kohorn | 463/40 |
| 2001/0003100 | A1 | 6/2001 | Yacenda | 463/41 |

FOREIGN PATENT DOCUMENTS

| | | | |
|---|---|---|---|
| EP | 0 624 039 A2 | 11/1994 | H04N/7/173 |
| EP | 0 673 004 A2 | 9/1995 | G07F/17/32 |
| EP | 0 873 722 A1 | 10/1998 | A63F/9/22 |
| EP | 0 934 765 A1 | 8/1999 | A63F/9/22 |
| GB | 2 300 535 A | 11/1996 | H04N/5/262 |
| JP | 01-25659 | 1/1989 | H04M/11/00 |
| JP | 01-269157 | 10/1989 | G06F/15/28 |
| JP | 02-110660 | 4/1990 | G06F/15/28 |
| JP | 02-231671 | 9/1990 | G06F/15/28 |
| JP | 06-325062 | 11/1994 | G06F/15/28 |
| WO | WO 95/01058 | 1/1995 | H04N/7/16 |
| WO | WO 95/30944 | 11/1995 | |
| WO | WO 97/19428 | 5/1997 | G07F/17/32 |

OTHER PUBLICATIONS

Maury Wolff, "Interactive Wagering a Good Bet," Daily Racing Form, Jan. 29, 1995, p. 4.

John Burgess, "And We're Off To The Races!" The Washington Post, Jan. 16, 1995, pp. 17–18.

Ross Peddicord, "New On TV: You Bet Your Horse," The Sun, Baltimore, Maryland, Dec. 15, 1994.

Yee–Hsiang Chang et al., "An Open–Systems Approach To Video On Demand," IEEE Communications Magazine, May 1994, pp. 68–80.

TrackMaster User's Guide Version 2.0.7, Apr., 1994, AXCIS Pocket Information Network, Inc., Santa Clara, California, p. 1–122.

Kanichiro Yoshizawa et al., "Voice Response System for Telephone Betting," Hitachi Review vol. 26, No. 6, 1977, pp. 215–200.

Tiny Tim Brochure, AutoTote Systems, Inc., Newark, Delaware, at least as early as Sep. 1993.

Probe XL Brochure, AutoTote Systems, Inc., Newark, Delaware, Sep. 1993.

INTERACTIVE WAGERING SYSTEMS AND METHODS WITH MULTIPLE TELEVISION FEEDS

This is a continuation of U.S. patent application Ser. No. 09/826,531, filed Apr. 4, 2001 now U.S. Pat. No. 6,544,121, which claims the benefit of U.S. provisional patent application No. 60/194,803, filed Apr. 5, 2000, both of which are hereby incorporated be reference herein in their entireties.

BACKGROUND OF THE INVENTION

This invention relates to systems and methods for interactive wagering. More particularly, the present invention relates to systems and methods that provide interactive wagering systems and methods with multiple television feeds.

Wagering is a popular leisure activity. For example, many racing fans wager on events such as horse, dog, and harness racing. However, it may be inconvenient to attend racing events in person. Not all racing fans have sufficient time to visit racetracks as often as they would like and some fans have difficulties in obtaining suitable transportation to the track. Off-track betting establishments are available for fans who cannot attend racing events in person, but fans must still travel to the off-track betting establishments.

Interactive wagering using a set-top box wagering interface has become widely popular. An example of a set-top box wagering interface is illustrated in Marshall et al. U.S. patent application Ser. No. 09/330,651, filed Jun. 11, 1999, which is hereby incorporated by reference herein in its entirety. As shown therein, an interactive wagering interface can be presented on a wagerer's television alternatively or simultaneously with television racing coverage. Because television coverage of racing may be provided in conjunction with such an interface, the wagerer may feel as though he or she is at the race and thus may be enticed to participate in wagering.

The user may view television coverage of the race after creating or placing a wager or during the wager creation process. Typically, the user is provided with racing coverage on a channel that may be showing one of many races including races on which the user has not placed a wager. The user may only be interested in racing coverage for the races on which the user has placed wagers and may be frustrated that coverage for his or her race is not currently provided for his or her race.

In view of the foregoing, it would be desirable to improve such systems.

SUMMARY OF THE INVENTION

In accordance with the principles of the present invention, multiple television feed interactive wagering systems and methods may be provided to users. For example, a user may select one of multiple feeds corresponding to available cameras at a selected racetrack.

To take advantage of the ability to broadcast multiple racing feeds, some embodiments of the present invention provide systems and methods that enable the user to select from among the available television feeds through a virtual channel. The virtual channel is either separate from or integrated with an interactive wagering interface. In an interactive wagering interface that is presented through a user's set-top box, a user may select a particular race, which may cause a racing coverage channel to present the selected race to the user.

When a user selects a particular horse in a race, the selection may cause the channel to display a television feed that is selected for that horse. For example, upon placing a wager, the user may be provided automatically with television feed corresponding to the user's selected horse. This may give the user the feeling of being at the race. If desired, a user may be allowed to select one of the multiple television feeds for display.

Some embodiments of the present invention provide recorded television feed so that a user may interact with the television feeds at any time. The user may playback recorded television feeds and view the feed from different vantage points. For example, the user may desire to view the horses crossing the finish line from a different perspective.

DETAILED DESCRIPTION OF THE PREFERRED EMBODIMENTS

Figure 1:
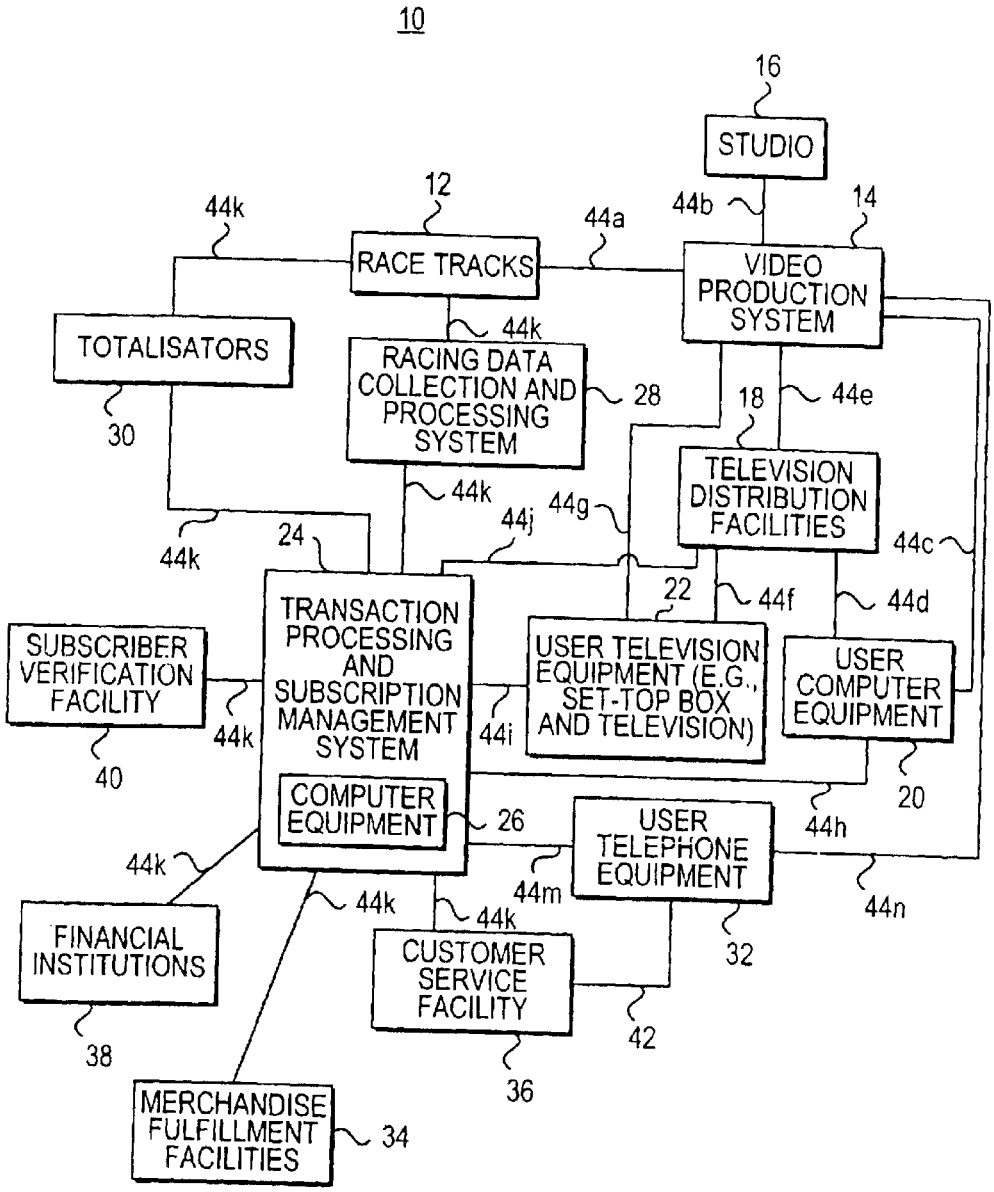
FIG. 1 is a schematic diagram of an illustrative interactive wagering system in accordance with the present invention.

An illustrative interactive wagering system 10 in accordance with the present invention is shown in FIG. 1. Aspects of the invention apply to various different types of wagering, but are described herein primarily in the context of interactive wagering on races (e.g., horse races) for specificity and clarity.

Races may be run at racetracks 12, which may be located at various geographic locations. Races run at racetracks 12 may be simulcast to television viewers. For example, simulcast videos may be provided to users with satellite receivers or to off-track betting establishments via satellite.

System 10 may be used to provide an interactive wagering service to users of various user equipment. An interactive wagering application may be used to provide the wagering service. The interactive wagering application may run locally on the user equipment (e.g., on a set-top box, personal computer, cellular telephone, handheld computing device, etc.) or may run using a client-server or distributed architecture where some of the application is implemented locally on the user equipment in the form of a client process and some of the application is implemented at a remote location (e.g., on a server computer or other such equipment in the system) as a server process. These arrangements are merely illustrative. Other suitable techniques for implementing the interactive wagering application may be used, if desired.

Real time videos from racetracks 12 may also be provided to video production system 14 for distribution to users as part of a television wagering service (i.e., a wagering-related television channel or Internet-delivered service or the like). If desired, multiple simulcast videos may be provided to video production system 14 in real time. Talent (e.g., commentators) for the television wagering service provided by the interactive wagering application may be located at studio 16. Studio 16 may provide a video feed containing commentary and the like to video production system 14. Graphic overlays for the television wagering service may be added to the service at video production system 14.

The television wagering service may use video production system 14 to combine selected video segments from desired racing simulcasts with the video feed from studio 16 and suitable graphic overlays. If desired, video production system 14 or a separate facility may be used to reformat simulcasts from racetracks 12. For example, if racetracks 12 provide simulcasts as traditional analog television channels, video production system 14 (or a separate facility) may convert these simulcasts or portions of these simulcasts into digital signals (e.g., digital video signals) or into a different number of analog signals. Digital video signals may require less bandwidth than analog video signals and may be appropriate for situations in which videos are to be transmitted over either high or low bandwidth pathways. Low bandwidth pathways may include telephone lines, the Internet, etc.

Video production system 14 may be used to provide a television wagering service that includes selected simulcast videos, video from studio 16, and graphic overlays to television distribution facilities 18 (for redistribution to user television equipment 22 and user computer equipment 20), to user computer equipment 20, and to user telephone equipment 32 (if user telephone equipment 32 has a display capable of displaying moving images). Television distribution facilities 18 may be any suitable facilities for supplying television to users, such as cable system headends, satellite systems, broadcast television systems, or other suitable systems or combinations of such systems. User computer equipment 20 may be any suitable computer equipment that supports an interactive wagering application. For example, user computer equipment 20 may be a personal computer. User computer equipment 20 may also be based on a workstation, a networked computer or computers, a laptop computer, a notebook computer, a handheld computing device such as a personal digital assistant or other small portable computer, etc.

Each of television distribution facilities 18 is typically located at a different geographic location. Users with user television equipment 22 may receive the television wagering service from an associated television distribution facility. User television equipment 22 may include, for example, a television or other suitable monitor. A television may be used to watch the television wagering service on a traditional analog television channel. User television equipment 22 may also include a digital or analog set-top box connected to a television distribution facility 18 by a cable path. A digital set-top box may be used to receive the television wagering service on a digital channel. If desired, user television equipment 22 may contain a satellite receiver, a WebTV box, a personal computer television (PC/TV), or hardware similar to such devices into which set-top box capabilities have been integrated. A recording device such as a videocassette recorder or digital recording device (e.g., a personal video recorder (PVR) or digital video recorder (DVR) based on hard disk drives or the like) may be used in user television equipment 22 to store videos. The recording device may be separate from or part of the other components of user television equipment 22.

Figure 2:
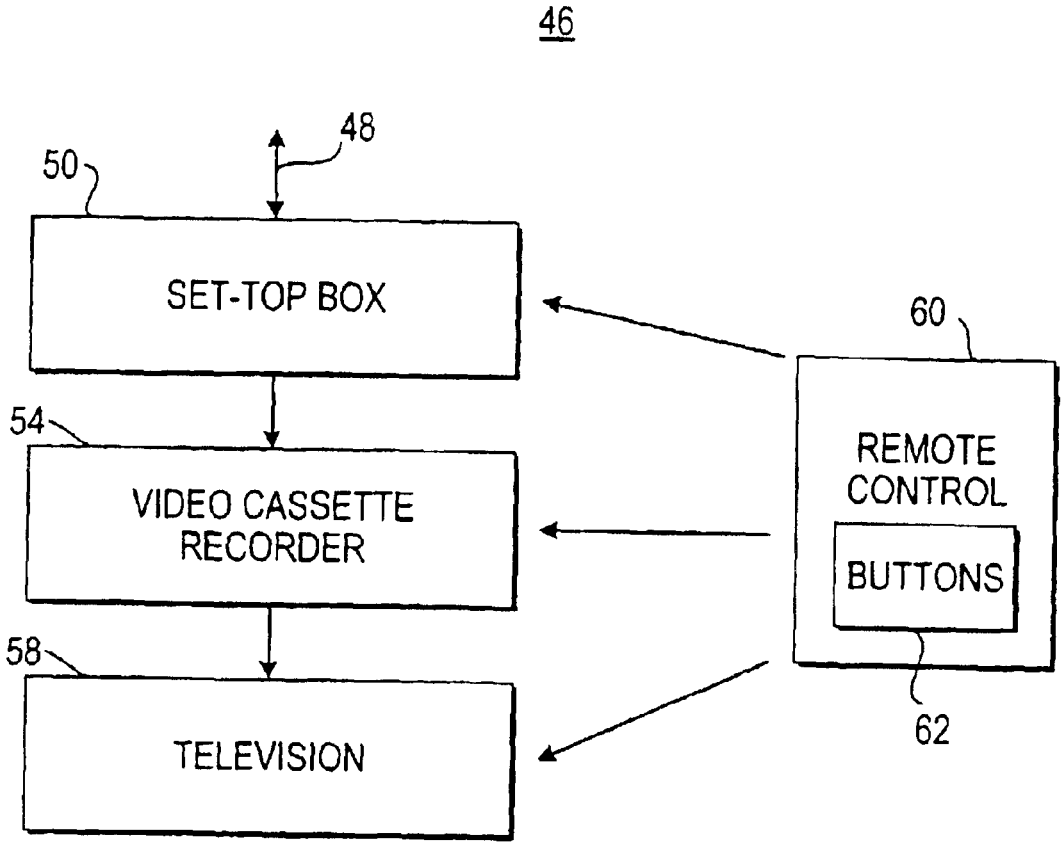
FIG. 2 is a schematic diagram of illustrative user television equipment in accordance with the present invention.

Illustrative user television equipment 46 is shown in FIG. 2. Set-top box 50 may receive television programming and data at line or input 48. Set-top box 50 may have analog and digital television tuning circuitry for handling analog and digital television signals. Television signals may be passed to videocassette recorder 54, which is separate from the hardware (i.e., set-top box 50) that implements the television wagering application, for recording. Set-top box 50 may also control the operation of videocassette recorder 54. For example, set-top box 50 may issue infrared commands that are received by videocassette recorder 54 at the same inputs at which standard remote control commands are received.

Videocassette recorder 54 may be connected to television 58. Television programming and graphic display screens generated by applications implemented using set-top box 50 may be passed from set-top box 50 to television 58 through videocassette recorder 54.

Set-top box 50 has memory and processing circuitry. This allows set-top box 50 to be used to implement applications that support an interactive wagering application, television wagering service, interactive television program guide, web browsing and Internet access, and other services such as home shopping, home banking, and video-on-demand services, etc.

A remote control 60 such as an infrared remote control may be used to control set-top box 50, videocassette recorder 54, and television 58. Remote control 60 may have buttons 62 such as a power button, right, left, up, and down arrow keys, an OK or select key, a favorites or fav key, a lock or parental control key, etc.

Figure 3:
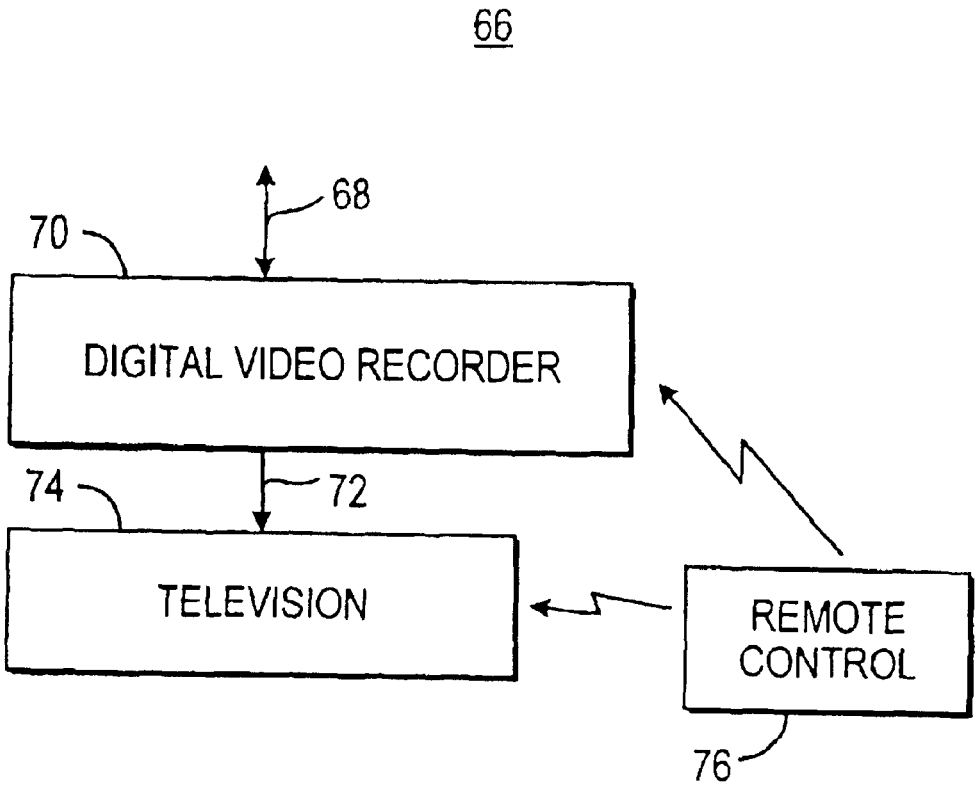
FIG. 3 is a schematic diagram of additional illustrative user television equipment in accordance with the present invention.

Illustrative user television equipment 66 based on a digital video recorder 70 is shown in FIG. 3. Digital video recorder 70 may receive television programming and may access interactive services using line or input 68. Digital video recorder 70 may have analog and digital tuning circuitry to receive and process television signals. Digital video recorder 70 may be used to record television programs in any suitable format. For example, digital videos may be stored using the MPEG-2 format.

Recorded videos or real-time videos from input 72 may be displayed on television 74 or any other suitable monitor. A remote control 76 such as an infrared remote control may be used to control digital video recorder 70 and television 74. Remote control 76 may have buttons such as a power button, right, left, up, and down arrow keys, an OK or select key, a favorites or fav key, a lock or parental control key, etc.

Digital video recorder 70 has memory and processing circuitry that allows digital video recorder 70 to be used to implement applications that support an interactive wagering application, television wagering service, interactive television program guide, web browsing and Internet access, and other services such as home shopping, home banking, and video-on-demand services, etc. Television programming and display screens generated by interactive applications may be displayed on television 74.

Referring back to FIG. 1, user computer equipment 20 may receive the television wagering service using a video card or other video-capable equipment to receive analog or digital (e.g., moving picture experts group or MPEG) videos from a television distribution facility. User computer equipment 20 may also receive the television wagering service directly from video production system 14 using, for example, a modem link. If desired, the video for the television wagering service may be compressed (e.g., using MPEG techniques). This may be useful, for example, if the path to user computer equipment 20 is a modem connection using telephone links. If video production system 14 is only used to serve user computer equipment 20 without traditional analog television capabilities, video production system 14 may only need to supply such digitally-compressed video signals and not analog television signals.

Figure 4:
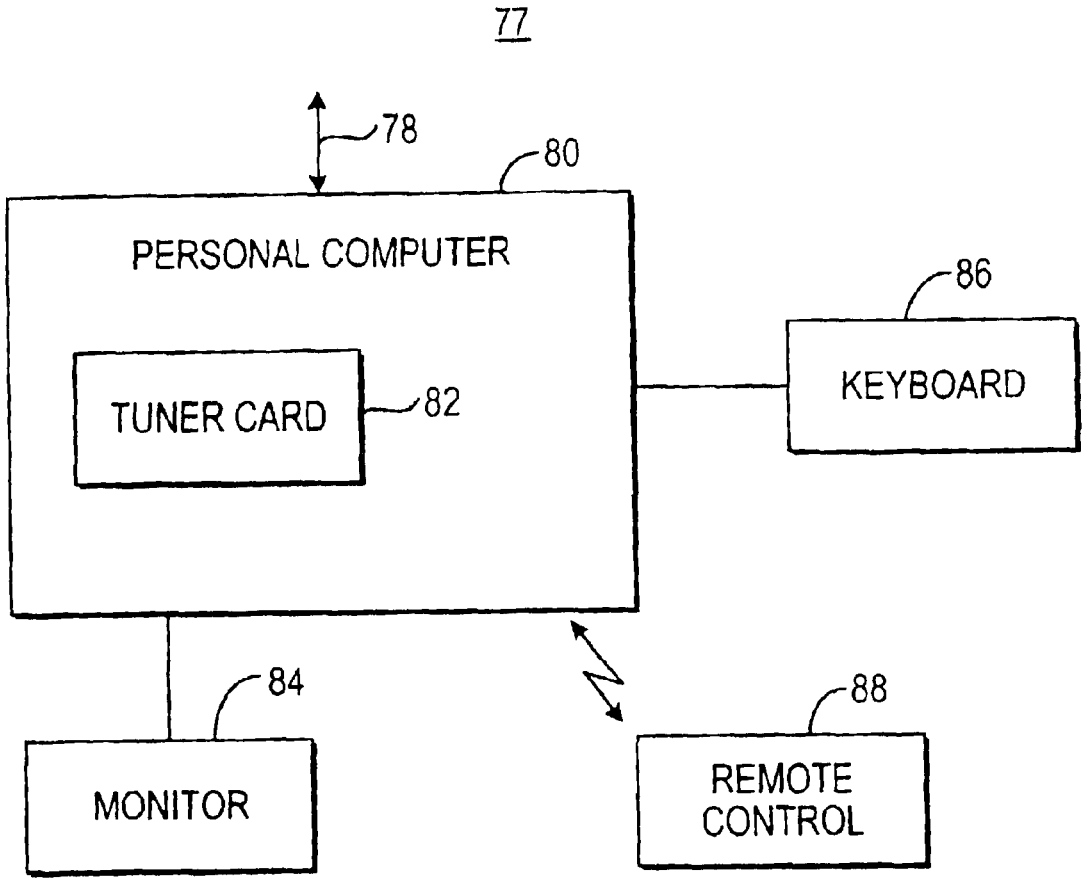
FIG. 4 is a schematic diagram of illustrative user computer equipment in accordance with the present invention.

Illustrative user computer equipment 77 is shown in FIG. 4. User computer equipment 77 may be based on a personal computer 80 or any other suitable computing device. Personal computer 80 may receive television programing and information for interactive services using line or input 78. Personal computer 80 may contain a tuner card 82 or other suitable circuitry for handling analog and digital television signals. Personal computer 80 may also contain memory and processing circuitry that allows personal computer 80 to be used to implement applications that support an interactive wagering application, television wagering service, interactive television program guide, web browsing and Internet access, and other services such as home shopping, home banking, video-on-demand services, etc. Personal computer 80 may contain a storage device such as a hard disk drive to store videos. Television signals and screens generated by interactive applications may be displayed on monitor 84.

The user may interact with personal computer 80 using any suitable user input interface, such as keyboard 86, a pointing device such as a trackball, mouse, or touch pad, a voice recognition system, a handwriting recognition system, etc. If desired, the user may interact with personal computer 80 using a wireless remote control such as remote control 88. Remote control 88 may be, for example, an infrared remote control.

Referring back to FIG. 1, video clips of races and other simulcast information may be provided to users in the form of a television wagering service or by an interactive wagering service provided by the interactive wagering application. If desired, race-related videos may be provided to the user by using video production system 14 or other suitable equipment to route appropriate video clips from the simulcasts to the user in real time. Video clips may also be stored for later viewing. For example, one or more video servers located at racetracks 12, video production system 14, television distribution facilities 18, or other suitable locations may be used to store video clips. The stored videos may then be played back in real time or downloaded for viewing at user television equipment 22, user computer equipment 20, or user telephone equipment 32. The video clips may contain videos of races, commentary, interviews with jockeys, or any other suitable race-related information. If desired, real-time or stored videos may be provided from racetracks 12 directly to user television equipment 22, user computer equipment 20, or user telephone equipment 32 over the Internet or other suitable communications paths without involving video production system 14. Videos may also be provided by routing video signals through equipment located elsewhere in system 10. For example, videos may be routed through transaction processing and subscription management system 24.

In some embodiments, video clips of races, real-time videos of races, or any other simulcast may be transmitted through multiple feeds to user television equipment 22, user computer equipment 20, user telephone equipment 32, or any other suitable user equipment. For example, one or more cameras at racetracks 12 may transmit videos from the cameras to video production system 14. Video production system 14 may transmit the videos created at racetracks 12 to television distribution facilities 18, which may transmit the videos using one or more television feeds to user television equipment. As discussed below, videos may be provided to television distribution facilities 18 and/or user television equipment 22 as digital signals by, for example, having a number of digital videos (e.g., ten or more digital video channels) carried on a single analog television feed. However, any other suitable approach may be used.

Television distribution facilities 18, video production system 14, or any other suitable facility may transmit multiple television feeds. Television distribution facilities 18 or video production system 14 may provide a plurality of television feeds that each correspond to a race (e.g., a race that is available for wagering on the system). Moreover, each television feed that is for a particular race may be, for example, on a single channel that may carry a number of digital feeds for the race that correspond to that channel. For example, video production system 14 may transmit ten digital videos for one available race on one feed. A television feed may carry race-related information corresponding to the race that is on that television feed. Race-related information may include race-related statistics, weather information, commentary, feed information, or any other suitable information. For example, television feed number two may be assigned to all races at Churchill Downs. When a user creates a wager and bets on a horse racing a Churchill Downs, television distribution facilities 18 or video production system 14 may distribute television feed number two to the user with the race-related information.

Other examples may include distributing information about which television feeds for a particular race are related to which race characteristics (e.g., which horse, camera angle, etc.) For example, television feed number two may be assigned to horse number two at Churchill Downs. Television feed number two may provide the user (e.g., wagerer) with videos of races, commentary, feed information, or any other suitable race-related information pertaining to horse number two at Churchill Downs. The television feed information may provide sufficient information to allow a user to select an appropriate feed for a wager or to allow the system to automatically select an appropriate feed for a wager. The feed information may be carried with the television feeds, separate from the feeds (e.g., using a computer connection), or in a combination thereof. Examples of paths for communicating data are discussed in connection with FIG. 1. Any other suitable approach may be used.

Transaction processing and subscription management system 24 may contain computer equipment 26 and other equipment for supporting system functions such as transaction processing (e.g., handling tasks related to wagers, product purchasing, adjusting the amount of funds in user accounts based on the outcomes of wagers, video clip ordering, etc.), data distribution (e.g., for distributing racing data to the users), and subscriber management (e.g., features related to opening an account for a user, closing an account, allowing a user to add or withdraw funds from an account, changing the user's address or personal identification number, etc.). Databases within transaction processing and subscription management system 24 or associated with system 24 may be used to store racing data, wagering data and other transaction data, and subscriber data such as information on the user's current account balance, past wagering history, individual wager limits, personal identification number, billing addresses, credit card numbers, bank account numbers, social security numbers, etc. Using such databases may allow the user to access information more quickly and allows for central administration of the wagering service.

If desired, racing videos and other services may be provided using servers and other equipment located at transaction processing and subscription management system 24. For example, video clips may be provided to the user on-demand. Interactive advertisements may be provided to the user. When the user selects a desired advertisement, transaction processing and subscription management system 24 may provide additional information or other services related to the advertisement to the user.

Product ordering services may be implemented using computer equipment at transaction processing and subscriber management system 24 to handle orders and to assist in adjusting the appropriate account of the user accordingly orders may be fulfilled using merchandise fulfillment facilities 34. Merchandise fulfillment facilities 34 may be operated solely to provide merchandise fulfillment or may be associated with independently-operated mail-order or on-line businesses. Similar facilities may be used to allow users to order services.

Statistical racing data such as the post times for each race, jockey names, runner names and the number of races associated with each track, handicapping information (e.g., information on past performances such as the number of wins and losses for the past year, etc.), and weather conditions at various tracks may be provided by racing data collection and processing system 28. Some of the data may be collected from racetracks 12 and some may be provided by third party information sources such as Axcis Pocket Information Network, Inc. of Santa Clara, Calif. or other suitable data sources.

Racing data may also be provided from totalisators 30. Totalisators 30 are the computer systems that may be used to handle wagers made at the racetracks, made at off-track betting establishments, and made using interactive wagering system 10. Totalisators 30 generate wagering odds in real time. Totalisators 30 generate these odds based on information on which wagers are being placed (e.g., based on information on which wagers are being placed on races at racetracks 12). Totalisators 30 are available from companies such as Amtote International, Inc. of Hunt Valley, Md. Totalisators 30 may be associated with individual racetracks 12 or groups of racetracks 12. Totalisators 30 may communicate with one another using a communication protocol known as the Intertote Track System Protocol (ITSP). This allows totalisators 30 to share wagering pools. Totalisators 30 may provide racing data including information on the current races at racetracks 12, the number of races associated with each racetrack, win, place, and show odds and pool totals for each horse or other runner, and exacta, trifecta, and quinella payoff predictions and pool totals for every possible combination of runners. Totalisators 30 may also provide current odds and other real time racing data for other types of wagers. Totalisators 30 may provide the time until post time for each race.

Totalisators 30 may provide race results, such as the order-of-finish list for at least the first three positions and payoff values versus a standard wager amount for win, place, and show, for each runner in the finish list. Payoff values may be provided for winning complex wager types such as exacta, trifecta, quinella, pick-n (where n is the number of races involved in the pick-n wager), and daily double. The payoff values may be accompanied by a synopsis of the associated finish list.

Totalisators 30 may also provide program information of the type typically provided in printed racing programs. Such program information may include early odds, early scratches, race descriptions (including the distance of each race and the race surface—grass, dirt, artificial turf, etc.), allowed class ratings (based on a fixed ratio of external criteria), purse value (payoff to winning runner), allowed age range of runners, and the allowed number of wins and starts for each runner.

If desired, some of the information provided to transaction processing and subscription management system 24 by totalisators 30 (such as the program information or other suitable racing data) may be provided by racing data collection and processing system 28. Similarly, some of the information provided to transaction processing and subscription management system 24 by racing data collection and processing system 28 may be provided by totalisators 30. Moreover, the foregoing examples of different suitable types of racing data are merely illustrative. Any suitable data related to racing may be provided to transaction processing and subscription management system 24, if desired.

Transaction processing and subscription management system 24 provides the racing data to users at user television equipment 22, user computer equipment 20, and user telephone equipment 32 for use in following race results and developing wagers. If desired, racing data may be provided to users using paths that do not directly involve transaction processing and subscription management system 24. For example, racing data may be provided from racing data collection and processing system 28 to user television equipment 22, user computer equipment 20, or user telephone equipment 32 using the Internet or other suitable communications paths.

User telephone equipment 32 may be a conventional telephone, a cordless telephone, a cellular telephone or other portable wireless telephone, or any other suitable telephone equipment. Users at user television equipment 22 and user computer equipment 20 may view information on the racing data on a television or other suitable monitor. Users at user telephone equipment 32 may listen to racing data using an interactive voice system. User telephone equipment 32 may be based on cellular telephones with displays. Users may view racing data displayed on such displays.

Figure 5:
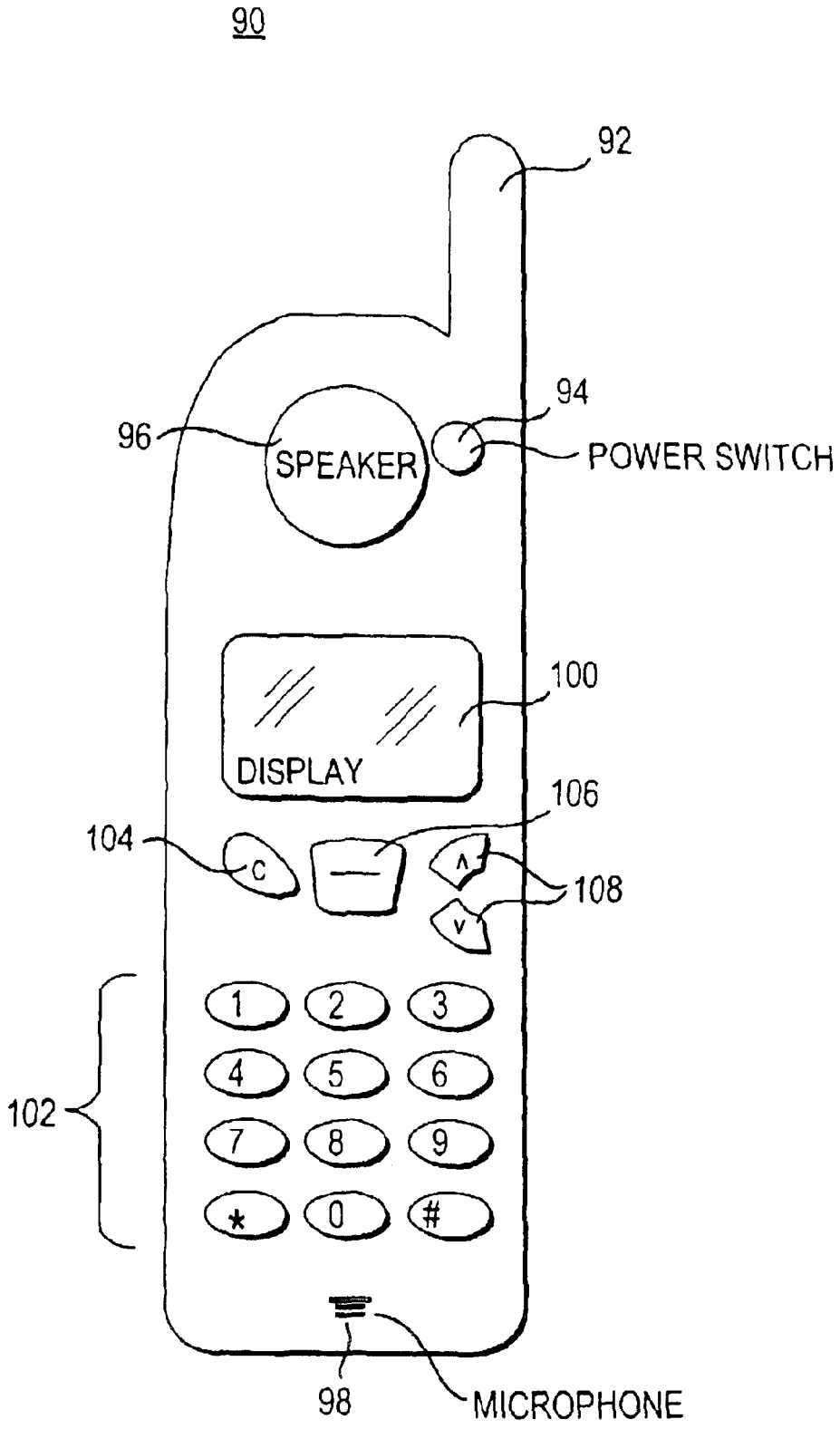
FIG. 5 is a diagram of an illustrative user cellular telephone equipment in accordance with the present invention.

An illustrative cellular telephone 90 with which the user may use the interactive wagering application is shown in FIG. 5. A portion of the software that is used to implement the interactive wagering service is resident on cellular telephone 90. Cellular telephone 90 may have a recording device for storing software instructions and videos and a processor for executing the instructions and displaying the videos.

Cellular telephone 90 may have an antenna 92 to support wireless communications with transaction processing and subscription management system 24, customer service facility 36, or video production system 14 (shown in FIG. 1). A power switch 94 may be used to turn on and off cellular telephone 90. A speaker 96 allows the user to hear conversations and to hear audio prompts from transaction processing and subscription management system 24 (FIG. 1). A microphone 98 allows the user to converse with others. Display 100 may be a liquid crystal display (black and white or color), a plasma display, a light-emitting diode display, an active matrix display, or any other suitable type of small display screen. Keys 102 allow the user to enter inputs. Numeric keys 102 (including the star and pound key) allow the user to respond to interactive voice response system prompts such as "press 3 to select race 3" and allow the user to enter numbers to select numerically identified on-screen menu options and the like that are displayed on display 100. If desired, some of the numeric keys 102 may perform secondary functions if, for example, they are pressed and held for at least a predetermined length of time. Clear key 104 may be used to clear characters from display 100. If the user presses and holds clear key 104, the user may be taken back to the initial screen displayed on display 100 upon power up. Navigation key 106 may be used to access menus, make telephone calls, etc. Scroll keys 108 may be used to scroll through menus and to scroll through other items presented on display screen 100.

Figure 6:
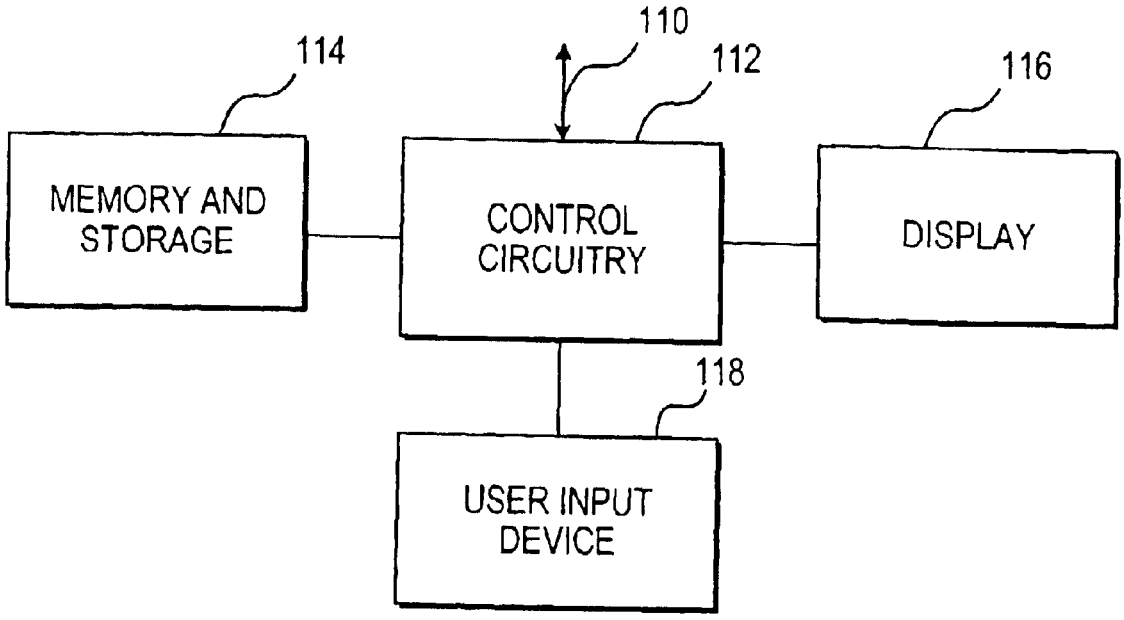
FIG. 6 is a schematic diagram of illustrative user equipment in accordance with the present invention.

A generalized schematic diagram of user equipment (i.e., user television equipment 22, computer equipment 20, and user telephone equipment 32 of FIG. 1) is shown in FIG. 6. Control circuitry 112 and memory and storage 114 may have communications and memory and processing circuitry for supporting functions such as receiving television programming, recording videos in storage, and accessing interactive services over line 110. Line 110 may connect to communications paths such as paths 42, 44*c*, 44*d*, 44*f–i*, 441*m*, and 44*n* of FIG. 1. Television programming and text, graphics, and video associated with interactive services may be presented to the user with display 116. Display 116 may be a television, a computer monitor, or any other suitable display equipment.

The user may interact with control circuitry 112 using any suitable user input device 118, such as a remote control, a keyboard, a wireless keyboard, a display remote, a handheld computer, a mouse, a trackball, a touch pad, or any other suitable input device.

Referring back to FIG. 1, users who wish to place wagers may establish an account at transaction processing and subscription management system 24. An account may also be established at one of totalisators 30. The user and the interactive wagering services may have their own bank accounts at financial institutions 38. A user may set up an account electronically by using user television equipment 22, user computer equipment 20, or user telephone equipment 32 to interact with the subscriber management functions of transaction processing and subscription management system 24. If desired, accounts may be established with the interactive wagering service with the assistance of customer service representatives at customer service facility 36. Customer service facility 36 may be at the same location as transaction processing and subscription management system 24, may be part of system 24, or may be located remote from system 24. Customer service representatives at customer service facility 36 may be reached by telephone. If user telephone equipment 32 is used to access the interactive wagering service, for example, user telephone equipment 32 may be used to reach the customer service representative using communications path 42. It user television equipment 22 or user computer equipment 20 is being used with the service, a telephone at the same location as that equipment may be used to reach the customer service representative.

The user's identity may be checked using social security number information or other identification information with the assistance of subscriber verification facility 40. The services of subscriber verification facility 40 are used to ensure that the user lives in a geographic area in which wagering is legal, that the user is of a legal age, and that the identification information (e.g., the user's social security number) matches the name provided by the user. If the user is using a cellular telephone or handheld computing device, the user's present physical location may be determined by determining which general part of the cellular telephone network is being accessed by the user or by using the cellular network or a handset-based location device such as a global positioning system (GPS) receiver in the body of the cellular telephone to pinpoint the user's location. This location information may be used to verify that the user is located in a geographic area where wagering is legal.

In a typical enrollment process, the user provides personal information to the interactive wagering service and provides funds with a credit card or funds from the user's bank account. The interactive wagering service sets up an account for the user at transaction processing and subscription management system 24 and directs one of totalisators 30 to set up a new account for the user at the totalisator. The totalisator is also directed to credit the user's account to reflect the amount of funds provided by the user. After the user places a wager and wins or loses, the totalisator adjusts the user's totalisator account to reflect the outcome of the wager. The totalisator may periodically inform the interactive wagering service of the adjusted balance in the user's account. This may be accomplished using any suitable technique (e.g., periodically, continuously, on-request, etc.). For example, reports may be collected periodically (e.g., once a day in an end-of-day report) and provided to the interactive wagering service to reconcile the account balances at transaction processing and subscription management system 24 with the account balances at totalisators 30.

If the user makes a balance inquiry, the inquiry may be passed to the appropriate totalisator by transaction processing and subscription management system 24. If the user is charged a fee for subscribing to the service, the service may debit the fee from the user's account at the transaction processing and subscription management system 24.

The accounts at totalisators 30 and transaction processing and subscription management system 24 are typically maintained separately, because the business entities that operate totalisators 30 and transaction processing and subscription management system 24 are independent. If desired, financial functions related to opening and maintaining user accounts and the like may be handled using computer equipment at another location such as one of financial institutions 38 or other location remote from totalisators 30 and system 24. Such financial functions may also be implemented primarily at a totalisator 30 or primarily at the transaction processing and subscription management system 24, if desired.

To take advantage of the ability to broadcast multiple television feeds, user television equipment 22 may automatically select a television feed thst corresponds to a particular user's wager. For example, when user television equipment 22 receives the user's wager, user television equipment 22 may request the corresponding television feed from television distribution facilities 18 or video production system 13. In response to the request, television distribution facilities 18 or video production system 13 may present the user with a television feed that corresponds to the user's wager. If desired, a plurality of television feeds and feed information that includes information about the relationship of each television feed to the race or race characteristics may be distributed to user television equipment 22. The feed information may be used manually or automatically to select an appropriate television feed for a current wager. Any other suitable approach may also be used.

In some embodiments, more than one wagering interface may be used to interact with the wagering system. For example, a particular user may be able to place wagers from user television equipment 22, user computer equipment 20, user telephone equipment 32, etc. The same user may also be able to access appropriate video from more than one of these wagering interfaces. The wagering system may be configured for a user to have different wagering interfaces operate cooperatively.

For example, the user may place a wager over a cellular telephone wagering interface. The system may send a communication about the wager to, for example, transaction processing and subscription management system 24, which may send the wager information to television distribution facilities 18. Television distribution facilities 18 may send the wager information to user television equipment 22 and, for example, inform the set-top box of the user's wager. If desired, the one wagering interface may send a communication (e.g., sends information on wagers) to another wagering interface, such as user television equipment 22, via a direct link between the two interfaces. When user television equipment 22 receives the wager information for the user, user television equipment 22 may request a television feed that corresponds to that user's wager from television distribution facilities 18 or video production system 14. In response to the request, television distribution facilities 18 or video production system 14 may transmit the television feed and/or race-related information that may correspond to that user's wager. Creating wagers from another wagering interface is discussed below in FIG. 28. However, any other suitable approach may also be used.

Users at user television equipment 22, user computer equipment 20, and user telephone equipment 32 may place wagers by providing wagering data and otherwise interacting with transaction processing and subscription management system 24. The interactive wagering service may provide a user at user television equipment 22, user computer equipment 20, or user telephone equipment 32 that has display capabilities with screens containing various racing data. For example, the user may be presented with screens that allow the user to view the current odds for horses in an upcoming race at a given track.

The service may provide the user with interactive screens containing menus and selectable options that allow the user to specify the type of wager in which the user is interested and the desired wager amount. With a set-top box arrangement, for example, the user may use a remote control or wireless keyboard to navigate the various menus and selectable options. With a personal computer, the user may use a keyboard, mouse, trackball, touch pad, or other suitable input or pointing device. With a cellular telephone with a display, the user may use buttons on the telephone. When the user has made appropriate selections to define a desired wager, user television equipment 22, user computer equipment 20, or user telephone equipment 32 may transmit wagering data for the wager to transaction processing and subscription management system 24.

Users with telephones may also interact with the service using an interactive voice response system located at transaction processing and subscription management system 24. The interactive voice response system may present menu options to the user in the form of audio prompts (e.g., "press 1 to select a $2 wager amount," etc.). The user may interact with the service by pressing the corresponding buttons on a touch tone telephone. User telephone equipment 32 that is based on cellular telephones allows the user to interact with the wagering service in this way. User telephone equipment 32 that is based on cellular telephones with messaging and display capabilities also allows the user to interact visually with the interactive wagering service.

The components of system 10 may be interconnected using various communications paths 44. Communications paths 44 may include satellite paths, coaxial cable paths, fiber-optic paths, twisted pair paths, other wire or cable-based links, wireless paths through free space, or any other suitable paths or combination of such paths. Communications over paths 44 may involve analog transmissions, digital transmissions, wireless transmissions, microwave transmissions, radio-frequency transmissions, optical transmissions, audio transmissions, or any other suitable type of transmissions or combination of such transmissions. Communications may involve Internet transmissions, private network transmissions, packet-based transmissions, television channel transmissions, transmissions in the vertical blanking interval of a television channel or on a television sideband, MPEG transmissions, etc. Communications may involve wireless pager or other messaging transmissions. Communications paths 44 may include cable connected to cable modems, digital subscriber lines, integrated services digital network (ISDN) lines, or any other suitable paths. Examples of suitable communications paths are described below. Those examples are, however, merely illustrative. Any of the communications path arrangements described above or other suitable arrangements may be used, if desired.

Communications paths that carry video and particularly uncompressed analog video or lightly-compressed or full-screen digital video generally use more bandwidth than communications paths that carry only data or that carry partial-screen digital video. For example, if it is desired to transmit high-quality simulcasts of races from racetracks 12 to video production system 14, analog or digital videos may be transmitted from racetracks 12 to video production system 14 over path 44*a* using satellite links. Video may be transmitted from studio 16 to video production system 14 over path 44*b* using a satellite link or a high-speed terrestrial path such as a fiber-optic path. Studio 16 may also be located at the same site as video production system 14, thereby avoiding the need for a long-haul transmission path. Videos may be transmitted from video production system 14 to user computer equipment 20 over path 44*c* using a modem link (using, for example, a digital subscriber line, a telephone network link, a wireless link, etc.). The modem link may be made over a private network.

A user with a cable modem may connect a personal computer or other such user computer equipment 20 to an associated cable system headend using path 44*d*. (The headend in such an arrangement would be one of the television distribution facilities 18 shown in FIG. 1.) The user may then receive videos from the headend via cable modem. Videos may be provided to the headend over path 44*e* using a network link, fiber optic links, cable links, microwave links, satellite links, etc. A user with a set-top box or similar device (shown in FIG. 1 as user television equipment 22) may also receive videos from a cable system headend using a cable modem or other such communications device over path 44*f*. In addition, a user with user television equipment may receive videos over the Internet or a private network using a telephone-based modem or other such communications device using path 44*g*. In a system with distributed processing, interactive wagering services may be provided using a television distribution facility 18 that includes equipment that supplements or replaces at least some of the equipment at transaction processing and subscription management system 24.

If desired, user television equipment 22 or user computer equipment 20 may receive analog or digital videos from an associated television distribution facility over the communications paths normally used to distribute television programming (e.g., paths 44*f* and 44*d*). For example, videos may be received as part of a dedicated interactive wagering service television channel. If videos are provided as digital signals (e.g., MPEG signals), ten or more digital videos may be carried on a single channel (or one digital video may be carried on one-tenth of the bandwidth of an analog channel). If the videos are not full-screen videos, even more videos may be simultaneously provided without a loss of image quality.

Racing videos may be provided to user telephone equipment 32 over a partially-wireless telephone Internet link or other telephone link using path 44*n*.

If desired, racing data may accompany the racing videos along any of these paths. Moreover, racing videos may be provided by routing them directly from racetracks 12 to user television equipment 22, user computer equipment 20 (e.g., over the Internet or a private network, etc.), or user telephone equipment 32. Racing videos may also be provided by routing them through transaction processing and subscription management system 24. If a cellular telephone or portable computing device has sufficient display capabilities to support moving images, racing videos may be displayed. Such videos may be provided using any suitable path, such as a direct path from racetracks 12, a path through video production system 14 or other suitable video processing equipment, through a hub such as transaction processing and subscription management system 24, etc. Racing videos may be provided in real time or may be recorded for later distribution. Videos that are not provided in real time may be downloaded by user television equipment 22, user computer equipment 20, a cellular telephone, or other suitable user equipment at a lower data rate than would otherwise be required and may be downloaded in the background, if desired. Such videos may also be provided to the user at real-time video rates for direct viewing by the user.

Although the features of the present invention are described herein in the context of providing multiple television feeds to user television equipment 22 (e.g., a set-top box). This is merely illustrative. Multiple television feeds may be provided to user telephone equipment 32, user computer equipment 20, or any other suitable platform. For example, multiple television feeds may be distributed to a cellular telephone that has appropriate hardware and software resources. Interactive wagering applications may present users with cellular telephones with racing videos on multiple screens or layered menus.

Racing data and other information related to the interactive wagering service may be provided to users over paths connected to transaction processing and subscription management system 24. For example, racing data and other data for the service may be provided to user computer equipment 20 over path 44*h* using a modem link. Path 44*h* may be a private network path or an Internet path. Path 44*h* may use telephone lines, digital subscriber lines, ISDN lines, wireless data paths, or any other suitable type of communications links. User television equipment 22 may receive data for the wagering service over communications path 44*i*, which may be a telephone line, digital subscriber line, ISDN line, or other suitable type of communications path and which may use a private network path or an Internet path, etc.

Data for the wagering service may be provided to users of the interactive wagering application via communications path 44*j* and paths 44*f* and 44*d*. Communications path 44*j* may be provided over a private network, using the public telephone network, using satellite links, or any other suitable type of links. Data from paths such as path 44*j* may be routed to paths such as paths 44*f* and 44*d* directly by associated television distribution facilities 18, or may be buffered at television distribution facilities 18, if desired. Paths 44*f* and 44*d* may include coaxial cable and use of paths 44*f* and 44*d* may involve the use of cable modems or the like. If data is provided over path 44*j* and paths 44*f* or 44*d* using an Internet protocol, a web browser or similar software running on user television equipment 22 or user computer equipment 20 may be used to access the data. Such software may be integrated into the interactive wagering application or may be used separately. Software may also be used to view videos and may be used on other platforms (e.g., advanced cellular telephones), if desired.

The communications paths 44*k* that are used to connect various other components of the system typically do not carry high-bandwidth video signals. Accordingly, paths 44*k* may be telephone-like paths that are part of the Internet or a private network. Such paths and various other paths 44 may be dedicated connections for security, reliability, and economy.

User telephone equipment 32 may receive information for the wagering service via path 44*m*. If user telephone equipment 32 is a standard (noncellular) telephone, such information may be in the form of audio prompts ("press 1 to place a wager") and audio racing data ("the current win odds for horse 2 are 5-1"). Transaction data processing and subscription management system 24 may contain interactive voice response equipment that provides such information to the user and that responds to touch-tone signals from the user when the user responds to prompts by pressing buttons on the user's telephone.

If user telephone equipment 32 is a cellular telephone, racing data and other information for the interactive wagering service may be provided to the user by using a cellular wireless connection as part of path 44*m*. Users with cellular telephones may be provided with audio prompts using an interactive voice response system located at transaction processing and subscription management system 24 to which the users may respond by pressing cellular telephone buttons to generate touch-tone signals.

Racing data and other information for the interactive wagering service may be provided to cellular telephones in the form of alphanumeric messages. Such messages may be transmitted to the user by using paging or other alphanumeric messaging formats or any other suitable data communications scheme. If desired, data may be provided to the cellular telephones over the voice channel and decoded by the cellular telephone using modem circuitry or other suitable circuitry. Data may also be provided using any other suitable cellular or wireless path. Regardless of the way in which racing data and other information for the interactive wagering service are provided to the cellular telephone, such information may be provided to the user by displaying it on the cellular telephone display screen or by presenting it in audible form through the speaker of the cellular telephone.

Racing data and other interactive wagering service information for the users may be provided in one or more continuous data streams, may be provided periodically (e.g., once per hour or once per day), or may be provided using a client-server arrangement in which data is requested by a client processor (e.g., user television equipment 22, user computer equipment 20, user telephone equipment 32, or any other such equipment) from a server (e.g., a server implemented using computer equipment 26 at transaction processing and subscription management system 24 or computer equipment at another suitable location). Videos may also be provided using any of these techniques.

A return communications path between the user and the interactive wagering service may be used to allow the user to place wagers and otherwise interact with the interactive wagering service. For example, a user with a standard telephone or a cellular telephone may interact with the service by pressing touch-tone keys on the telephone in response to audio prompts provided by an interactive voice response system at transaction processing and subscription management system 24. If desired, users may call customer service representatives at customer service facility 36 and place wagers with manual assistance. The user of a cellular telephone may interact with the wagering service by selecting menu options and otherwise interacting with information displayed on the cellular telephone. When a selection is made, software implemented on the telephone may be used to assist the user in transmitting appropriate data (e.g., wagering data) to the wagering service. Such data may be transmitted using any suitable technique. For example, data may be transmitted using a wireless data link that is separate from the cellular voice channels. Data may also be transmitted over the voice channel (e.g., using a modem built into the cellular telephone, by automatically generating touch-tone signals that may be recognized by the interactive voice response system at transaction processing and subscription management system 24, or using any other suitable arrangement). These approaches may be used even if the user receives racing data and other information for the service using a platform other than a telephone-based platform.

Users with user television equipment 22 may interact with the service by sending data (e.g., wager data) to transaction processing and subscription management system 24 using path 44*i* or using paths 44*f* and 44*j*. Users with user computer equipment 20 may send data (e.g., wager data) to transaction processing and subscription management system 24 via path 44*h* or paths 44*d* and 44*j*. Users at any user equipment may send data for the service to locations other than transaction processing and subscription management system 24. For example, the user may provide information directly to customer service facility 36, etc.

If desired, the user may send data to the service at transaction processing and subscription management system 24 using different paths than those used to receive data from transaction processing and subscription management system 24. For example, racing data may be received at user television equipment 22 via paths 44*j* and 44*f*, whereas data may be sent by the user from user television equipment 22 to transaction processing and subscription management system 24 using path 44*i*, etc. Moreover, the paths used to receive certain video information may be different from those used to receive racing data. For example, user television equipment 22 may receive racing videos using path 44*f*, but may receive racing data using path 44*i*. These examples are merely illustrative. Any suitable combination of paths may be used to distribute racing data and other information for the interactive wagering service, any suitable combination of paths may be used to receive videos, and any suitable combination of paths may be used to send data to the wagering service.

If desired, the user may interact with the wagering service using more than one platform. For example, the user may place a wager using a cellular telephone while the user is driving home. When the user arrives home, the user may determine the outcome of the wager by watching a video of the race on user television equipment. Later in the day, the user may check the user's account balance using a personal computer. This is merely an illustrative example. The various wagering platforms may be used in any suitable combination.

Although system 10 has been described in the context of a system that supports multiple wagering platforms, system 10 may support fewer platforms, if desired. For example, aspects of the invention may be implemented using a system 10 that only supports cellular telephone wagering or wagering using handheld computer devices. If desired, system 10 may be configured so that it does not support personal computer wagering, wagering with standard telephones, or wagering with user television equipment. The system may support cellular telephones and/or handheld computing devices such as personal digital assistants, palm-sized computers, etc., in combination with any other suitable platform.

The features of the present invention are sometimes described herein in the context of an interactive wagering application implemented on user television equipment. This is only illustrative. An interactive wagering application implemented on any suitable platform (user computer equipment, user telephone equipment, etc.) may be used to provide such features, if desired. In computer arrangements, on-screen options may be selected by clicking on them using a mouse pointer or other pointing arrangement. In set-top box arrangements, on-screen options may be made larger than they appear in computer-based arrangements to accommodate the greater viewing distance from which televisions are typically operated. Options may be selected by highlighting them using remote control arrow keys and by pressing an appropriate key such as an OK or enter or select key. In cellular telephone arrangements and handheld computer arrangements, options and information may be displayed using smaller screens than are typically available on personal computer or set-top box arrangements. To accommodate the smaller screen size, options that might otherwise be presented on a single screen may be displayed using multiple screens or layered menus. Options may be selected by highlighting them using navigation keys and pressing an appropriate select button on the cellular telephone or handheld computing device or by using a pen-based interface or the like.

The interactive wagering application may be implemented using application software that runs primarily on user television equipment, user computer equipment, user telephone equipment, or other local platform or using a remote server or other computer that is accessed from the local platform. Arrangements in which interactive wagering services are implemented using software on remote computers that is accessed on-demand from local platforms may be referred to as client-server arrangements. Such client-server arrangements may be used to allow client processes on set-top boxes or other platforms to access server processes running on servers located at cable system headends or other television distribution facilities 18 (FIG. 1). Regardless of the type of system architecture or platform used, the software that supports the interactive wagering service features described herein may be referred to as an interactive wagering application.

In a set-top box environment, the system may allow the user to launch the application by selecting a menu option in an interactive television program guide or other set-top box application or menu. If desired, the application may be launched automatically whenever the user tunes to a particular channel (e.g., the wagering-related television channel). After the user has tuned to this channel, the system may display an interactive icon on the user's television screen that indicates that the interactive wagering application is available. If the user presses an "OK" remote control key, the system may launch the application (as shown later in FIGS. 8 and 9).

In a computer-based system, the user may access the interactive wagering application by browsing to an Internet web site or a site on a private network.

Systems based on cellular telephones or the like may be launched by selecting an appropriate on-screen menu option presented on the display of the cellular telephone.

As television transmission capability advances, the ability to transmit an increased number of television feeds to a user's set-top box is possible. For example, rather than receiving only a single racing coverage channel, a user may currently receive multiple racing coverage channels. Moreover, the users may or may not be aware that multiple feeds are being transmitted to the user's equipment by using virtual channels.

Virtual channels may be positioned at any desired location in the channel-tuning sequence. For example, a virtual channel may be positioned between the lowest channel number and the highest channel number, such as a virtual channel 0. The virtual channel may appear to be a conventional channel to the user. However, it requires no additional bandwidth as a carrier. The virtual channel may be, for example, digitally produced at the transaction processing and subscription management system or included in a blanking interval in an existing bandwidth frequency. In this manner, the virtual channel is accessible by using the remote control. When accessed by the user, the virtual channel functions like a channel. Virtual channels are further discussed in Miller et al. U.S. Pat. No. 5,585,866, which is hereby incorporated by reference herein in its entirety.

Illustrative user interface approaches are described below. While the approaches are described separately, their features may be combined in any suitable way, modified in accordance with the other approaches, or performed instead of or in addition to the features of the approaches. Any suitable combination, substitution, or exchange of features between the interface approaches described herein, or with any other suitable interface approach, may be used. Also, although the illustrated embodiment of the user interface is directed to wagering on horse racing, it should be noted that this user interface could be modified for any type of wagering event.

Figure 7:
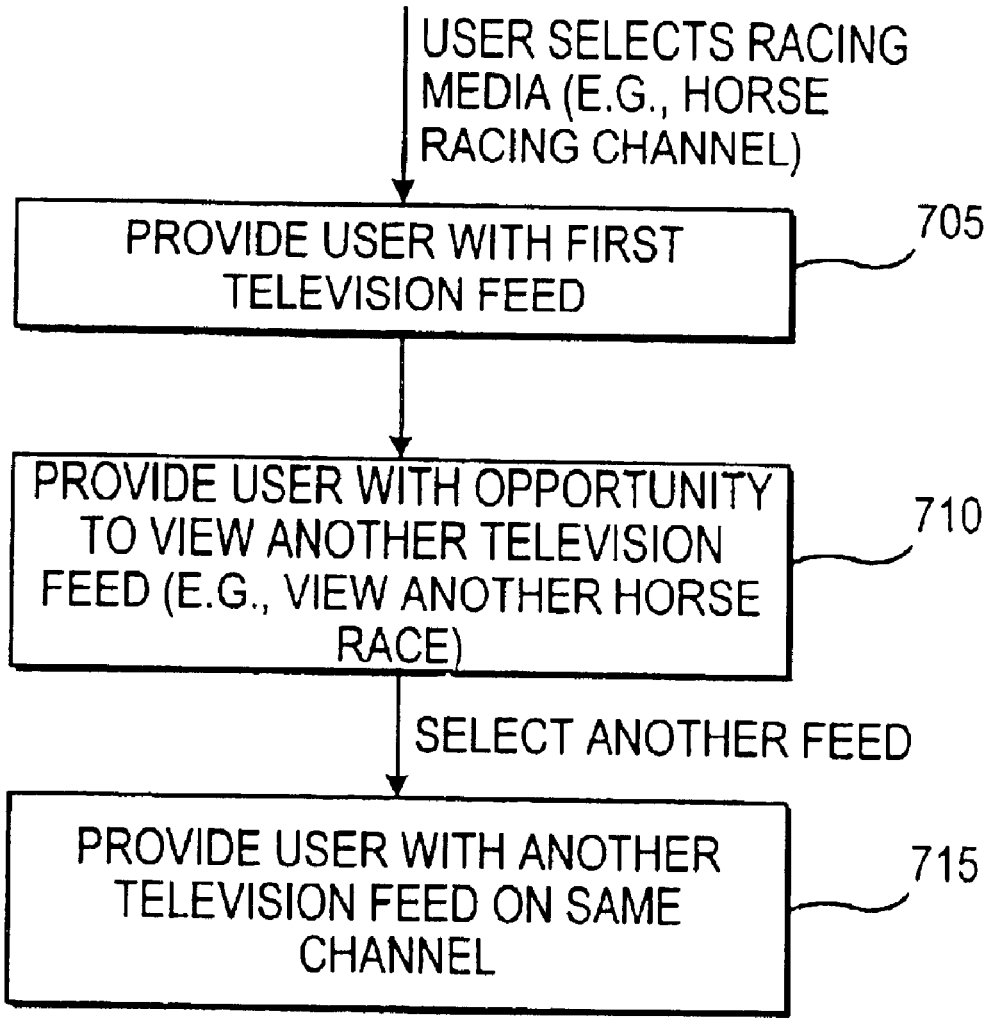
FIG. 7 is a flowchart of illustrative steps involved in allowing the user to view another television feed on the same channel in accordance with the present invention.
Figure 8:
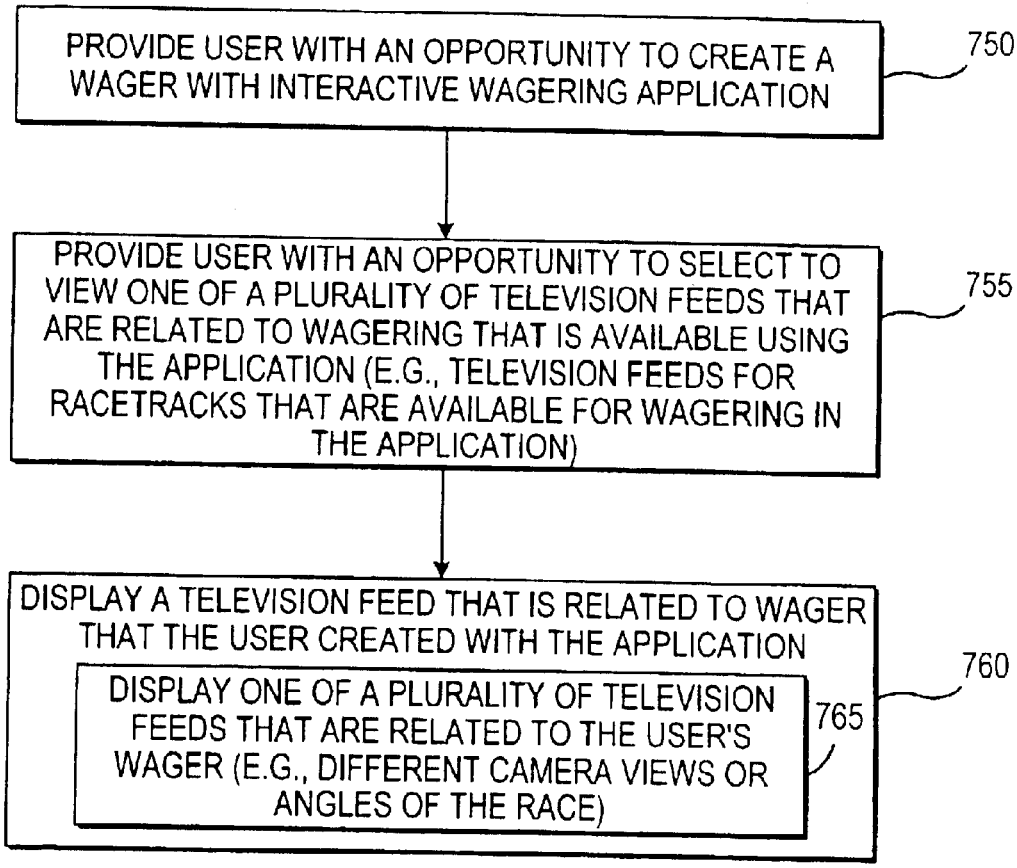
FIG. 8 is a flowchart of illustrative steps involved in displaying a television feed related to the wager created by the user in accordance with the present invention.
Figure 9:
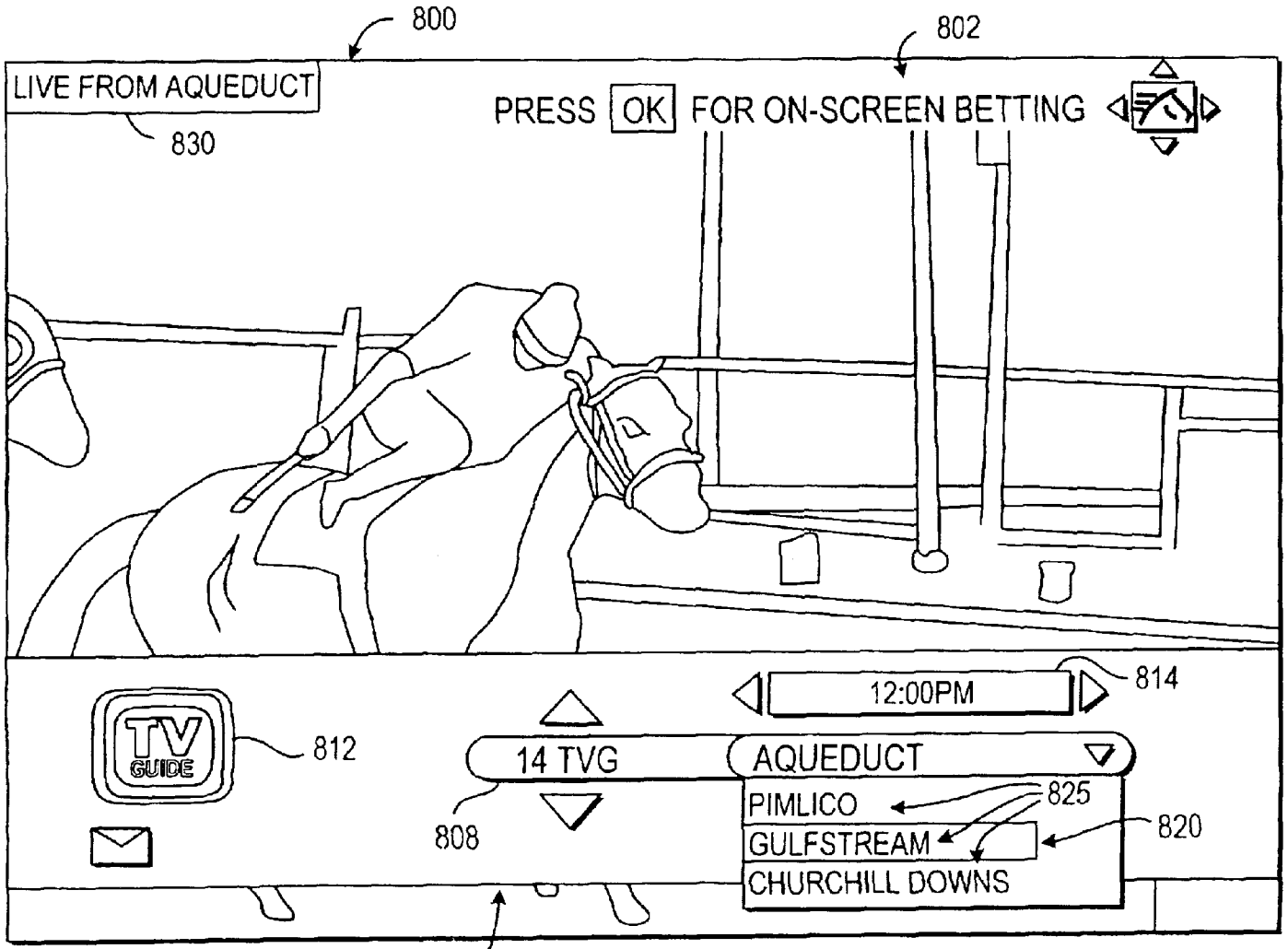
FIGS. 9 and 10 are illustrative screens that may present television coverage of racing in accordance with the present invention.

In some embodiments of the present invention, the user may be provided with multiple feeds to a single channel. In one approach, virtual channels may be used with the interactive wagering application. FIG. 7 is a flowchart illustrating some of the steps involved in allowing the user to view another television feed on the same channel. As shown in process 700 and as illustrated by FIGS. 8 and 9, the user may tune to a channel, such as a television channel. The channel may be associated with horse racing or gaming. The user may be provided with a television feed, such as racing coverage of a particular race, at step 705. However, the user may desire to view another television feed (e.g., race) at step 710. User indicators to view another race are received by, for example, video production system 14. At step 715, when the user selects another television feed, the user may be provided with another feed on the same channel by, for example, video production system 14, television distribution facility 18, or any other suitable system.

FIG. 8 is a flowchart of illustrative steps involved in displaying a television feed that is related to the wager created by the user. The television feed may be related to the wager by race, horse, jockey, horse number, jockey colors, horse colors, horse name, etc. At step 750, the interactive wagering application may provide the user with an opportunity to create a wager. At step 755, the interactive wagering application may provide the user with an opportunity to select to view one of a plurality of television feeds that are related to wagering that is available through the system. For example, the user may select one of ten available television feeds from a racetrack. In response to the user selecting a television feed, user may be presented with a display from a television feed that the user selected to watch a race that is related to a user's wager at step 760. At substep 765, in response to the user selecting one of a plurality of television feeds, the user may be presented with the selected television feed. For example, the user may be presented with different camera views or angles of the race related to the user's wager.

In screen 800 of FIG. 9, the user is presented with racing coverage of a particular race. Screen 800 may include any wager information, such as racing coverage, betting information, etc. Screen 800 includes feed indicator 830, which indicates that the user is currently viewing a race live from "AQUEDUCT." Screen 800 includes indicator bar 806, which may include racing menu 804, channel indicator 808, logo 812, and/or time selection 814. Indicator bar 806 indicates that the user has tuned to the "TVG" channel and that the channel is currently showing horse racing. As shown, racing menu 804, channel indicator 808, and time selection 814 may be changed by using the remote control. Racing menu 804 may be a menu bar, drop-down menu, or any other suitable graphics or animations for allowing the user to select another race.

As shown, racing menu 804 is a drop-down menu showing other races that may be available to the user. Racing menu 804 includes tracks 825 (e.g., "Pimlico," "Gulfstream," and "Churchill Downs"). The user may make on-screen selections by using the remote control or other suitable user interface to place a highlight region such as highlight region 820 on top of a desired selection and pressing an "OK," enter, or select key on the remote control. For example, the user may place highlight region 820 on top of racing menu 804. Upon pressing the select key, the user may change the racing venue by pressing the up and down navigation arrow keys on the remote control. Highlight region 820 may correspond with the user pressing the up and down arrow keys on the remote control. As shown, the user has placed highlight region 820 over the "Gulfstream" track. To change channels, the user may press channel up and channel down arrow keys on the remote control. Channel indicator 808 may reflect the changes as the user presses the channel up and channel down arrow keys.

In one approach, the "TVG" channel may be a virtual channel and the available races may be fed into the channels using multiple feeds. As shown in display 900 of FIG. 10, the user is presented with racing coverage of another race. Screen 900 may include similar features as display 800. As shown, display 900 also includes feed indicator 930, indicator bar 806, racing menu 804, channel indicator 808, logo 812, and/or time selection 814. Feed indicator 930 indicates that the user is viewing a race live from "GULFSTREAM." While race menu 804 of screen 800 presented the race live from "AQUEDUCT," race menu 804 of screen 900 reflects the user's decision to view the race live from "GULFSTREAM" on the same channel (e.g., the "TVG" channel).

Figure 10:
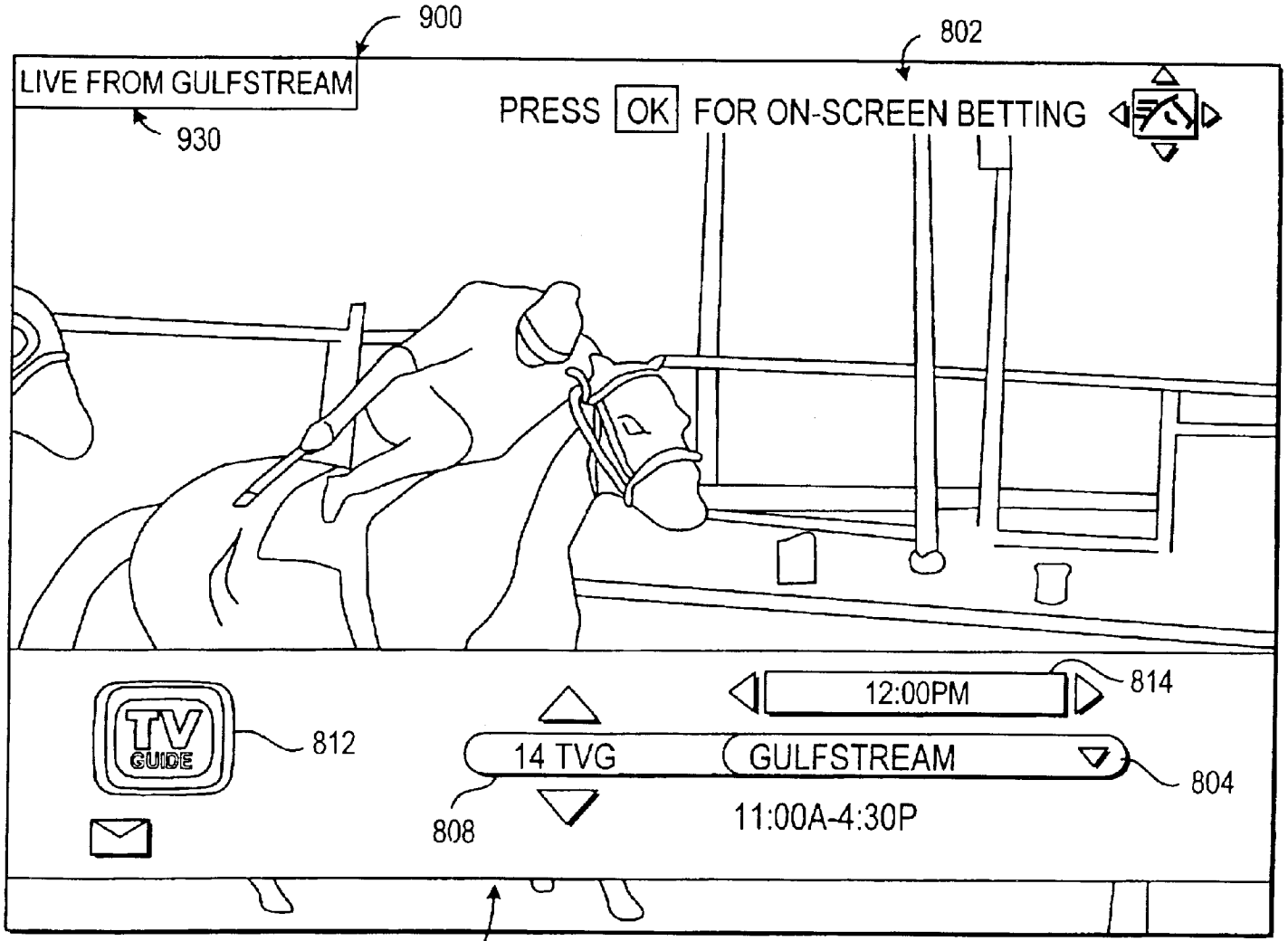

FIGS. 9 and 10 may also include prompt 802. After the user has tuned to this channel and selected a desired race to watch, the system may display an interactive prompt on the user's television screen that indicates that the interactive wagering application is available. When the user presses an "OK" remote control key, the system may launch the application and initiate a user interface. The user interface may provide the user with on-screen betting opportunities.

Figure 11:
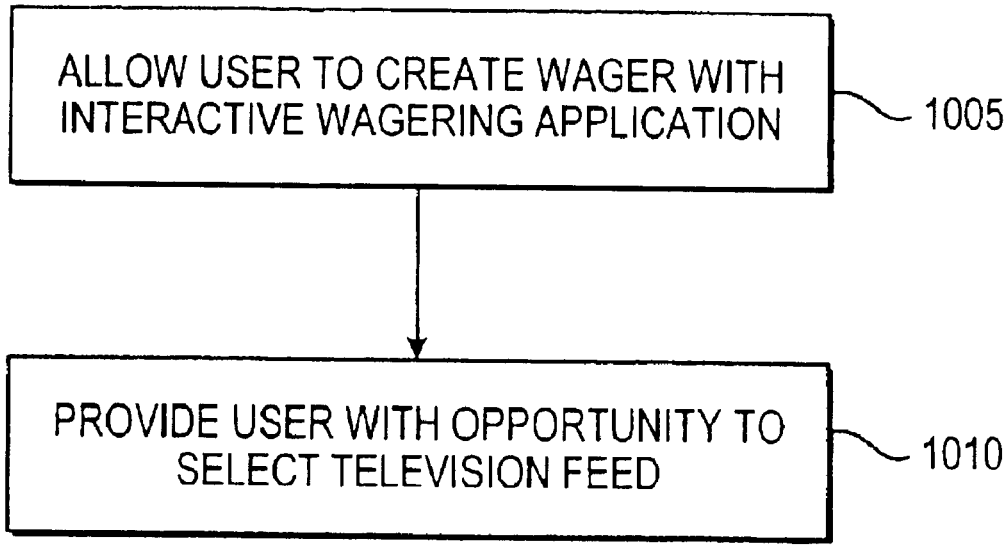
FIG. 11 is a flowchart of illustrative steps involved in allowing the user to select a desired television feed from multiple television feeds in accordance with the present invention.
Figure 12:
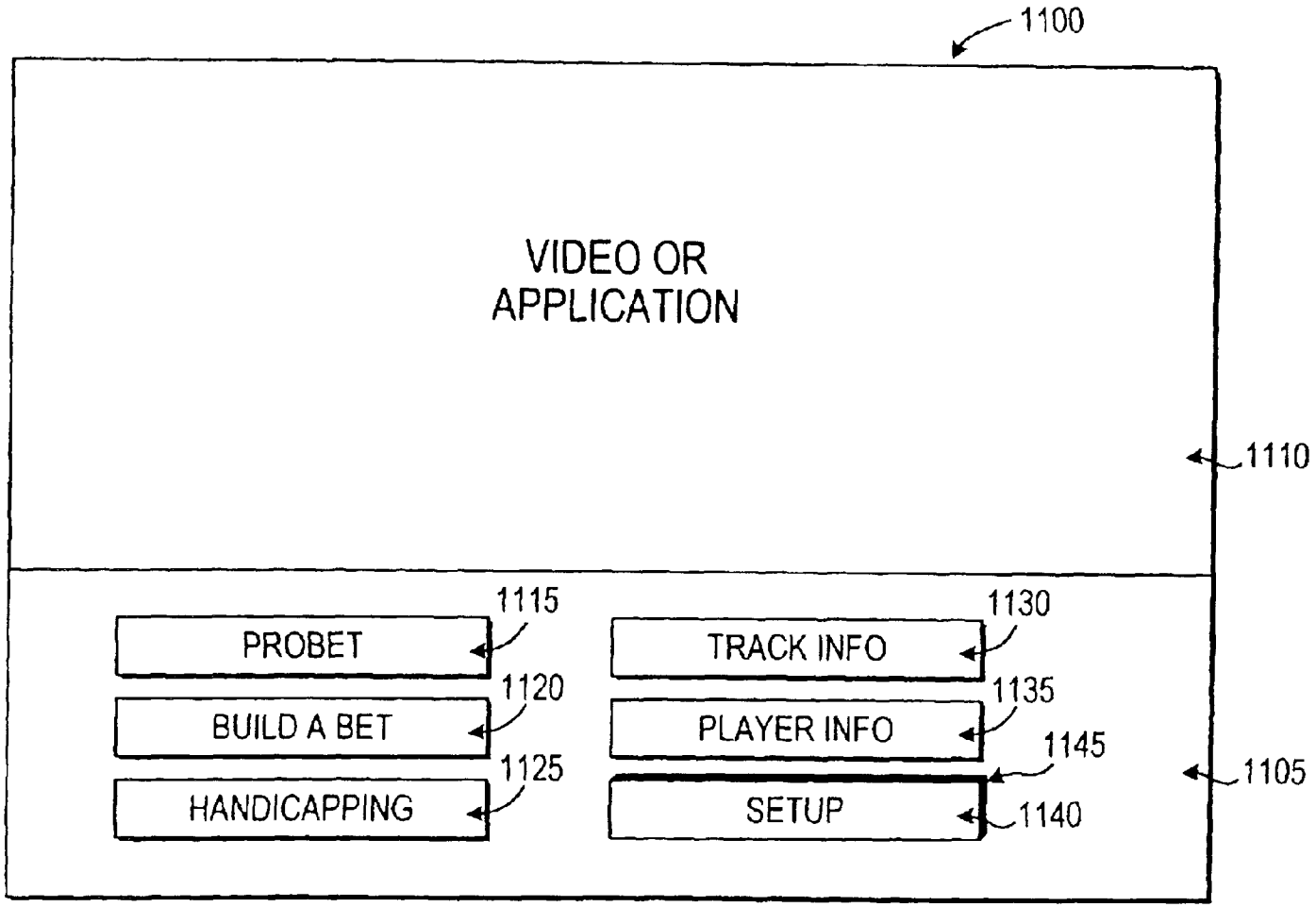
FIGS. 12–14 are illustrative screens that may be presented when the user desires to select a specific television feed in accordance with the present invention.
Figure 13:
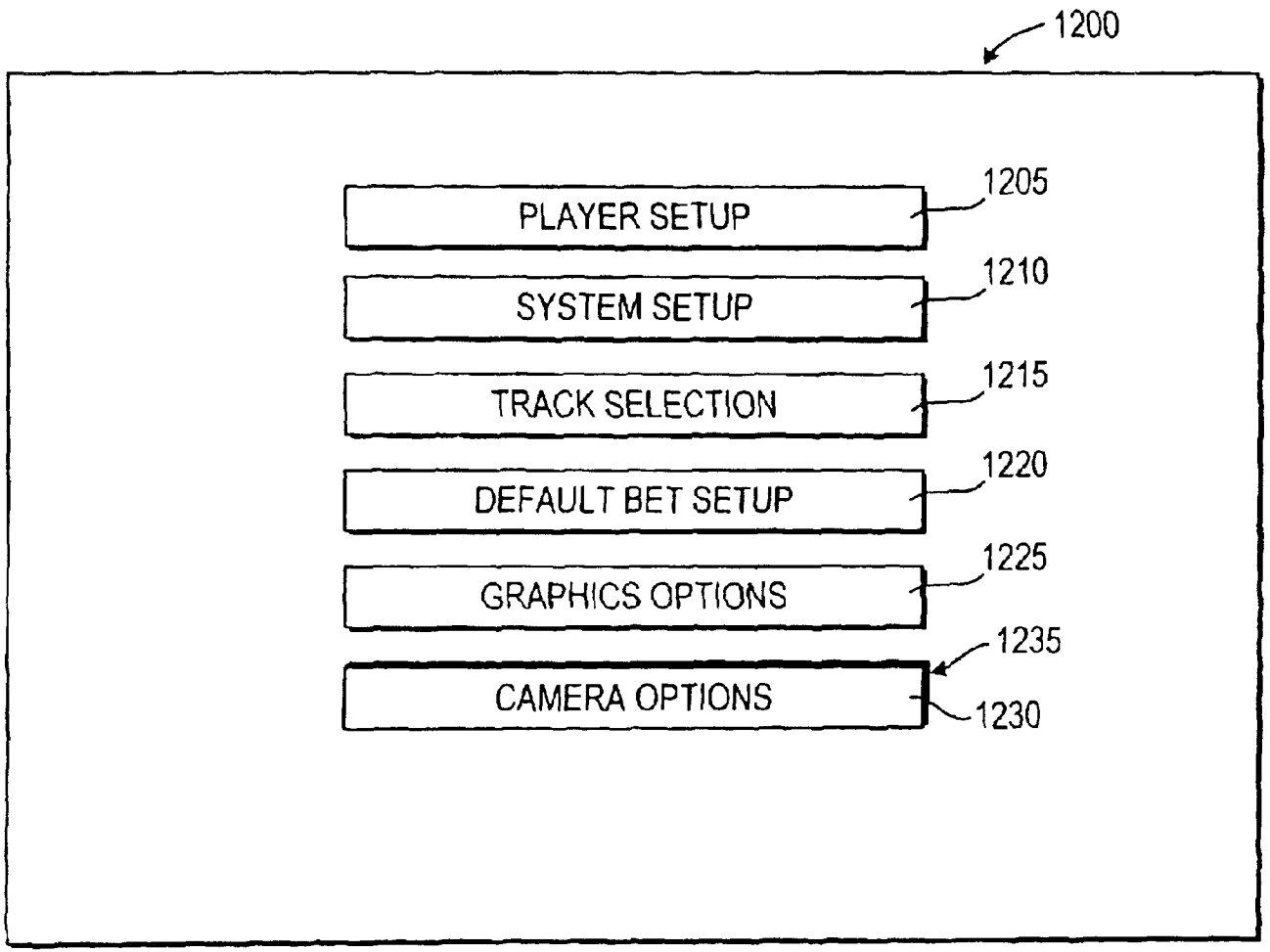
Figure 14:
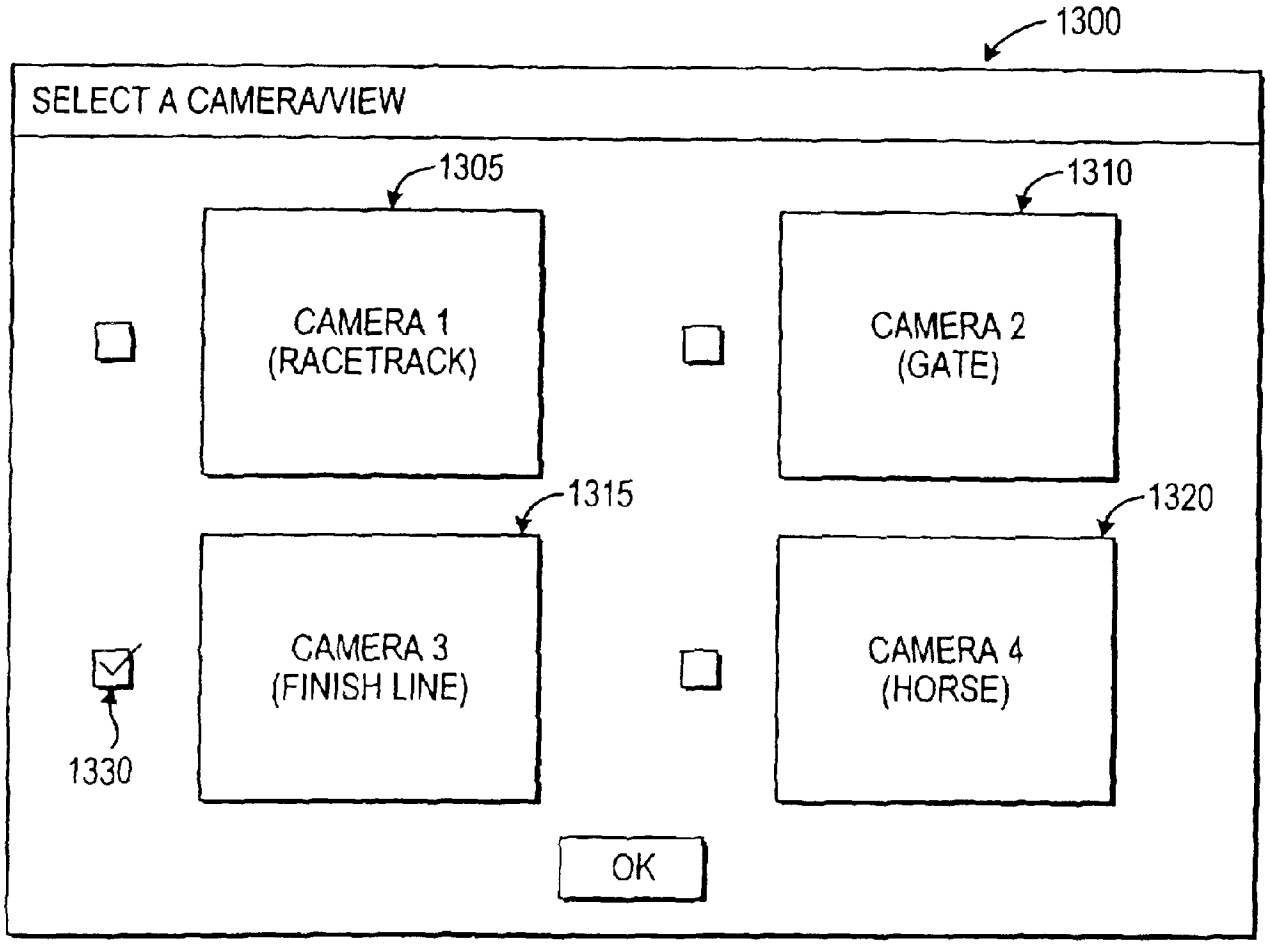

Some embodiments of the present invention may provide the user with options to select the feed to be viewed by the user. FIG. 11 is a flowchart of illustrative steps involved in providing a television feed based on the user's selection. As shown, at step 1005, the user may be provided with an opportunity to create a wager with the interactive wagering application. While navigating through the interactive wagering application, the user may select the desired television feed at step 1010. The desired feed may include a particular camera view or any other suitable feed. As shown in FIGS. 12–14, the user may select a feed by selecting the "setup" option.

FIG. 12 may provide the user with an illustrative interactive wagering menu 1105 that may be displayed with video or application region 1110 on screen 1100. Menu 1105 may include user-selectable options such as "Probet" option 1115 (e.g., an advanced wagering interface), "Build-a-Bet" option 1120 (e.g., a novice wagering interface), "Handicapping" option 1125, "Track info" option 1130, "Player info" option 1135, and "Setup" option 1140. User-selectable options may be selected when the user desires to create a wager or find information (e.g., handicapping information, track information, etc.) relating to placing a wager. Option 1140 may allow the user to adjust setup options. The user may place highlighted region 1145 over the desired option using the remote control or any other suitable approach. The user may select option 1140 or any other option displayed in menu 1105. These options may appear in any order and may be rearranged or modified according to user preference.

FIG. 13 is an illustrative display providing the user with setup options screen 1200. A user may select "Setup" option 1140 from menu 1105 (FIG. 12) to access setup screen 1200. Screen 1200 may include "Player Setup" option 1205, "System Setup" option 1210, "Track Selection" option 1215, "Default Bet Setup" option 1220, "Graphics Options" option 1225, and/or "Camera Options" option 1230. "Camera Options" 1230 may establish settings related to displays such as screen 800 of FIGS. 9 and 10. As shown, the user placed highlighted region 1235 over the desired "Camera Options" option 1230 using, for example, the remote control.

An illustrative camera options screen 1300 that may be displayed for the user when the user selects option 1230 of FIG. 13 is shown in FIG. 14. The "Camera Options" option 1230 may allow a user to select a television feed (e.g., camera view) for the user to view. For example, the user may select to view one of eight available cameras at a selected track. Each of the eight cameras may show a different view of the race. In screen 1300, choosing "Camera 1" option 1305 will correspond to a feed that is generated displaying the entire racetrack. "Camera 2" option 1310 may correspond to a feed showing the horses coming out of the gate, "Camera 3" option 1315 may correspond to a feed showing a view of the finish line, and "Camera 4" option 1320 may correspond to a feed showing a view of the user's selected horse. The view of the user's selected horse may be, for example, from a camera on the user's selected horse, from a camera looking forward on the horse directly behind the selected horse, from a camera looking backwards on the horse directly in front of the selected horse, or any other suitable view. The user has chosen option 1315 as shown by indicator 1330. The user may highlight or select any option on screen 1300 by using the remote control or any other suitable approach. Any other suitable arrangement may be used if desired, for example, other on-screen buttons, drop-down menus, audio options, etc. The arrangement of screen 1300 is merely illustrative.

Virtual channels may be used to direct a user's selection of a television channel to one of the available television feeds. In one approach, each feed may be provided on a physical television channel making each feed available on a single channel number on a television or set-top box by redirecting one of the physical channels to the virtual channel number. Some embodiments may provide the user with racing coverage or different feeds corresponding to the user's racing information using virtual channels.

Figure 15:
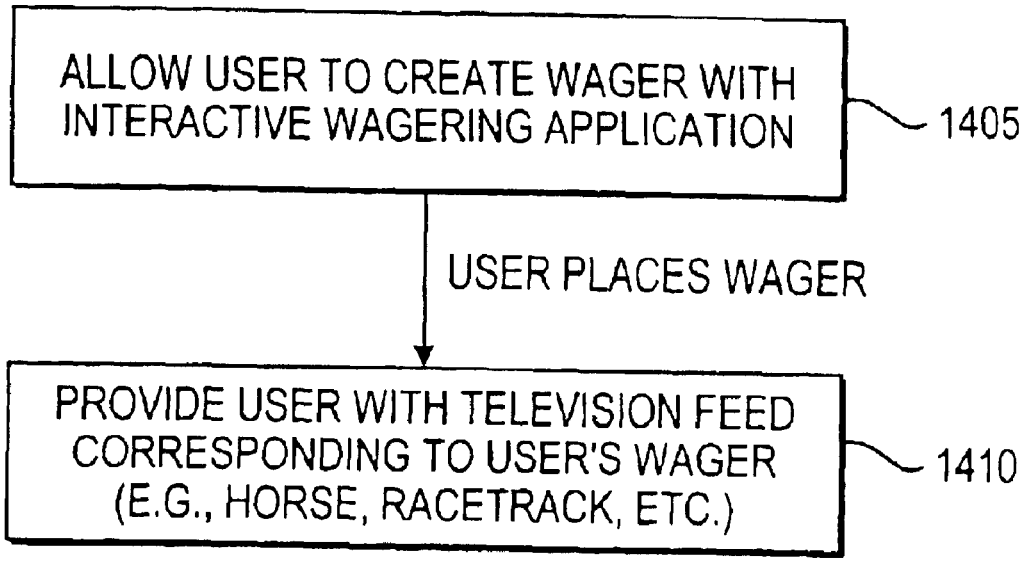
FIG. 15 is a flowchart of illustrative steps involved in providing the user with a television feed corresponding to the user's wager in accordance with the present invention.
Figure 16:
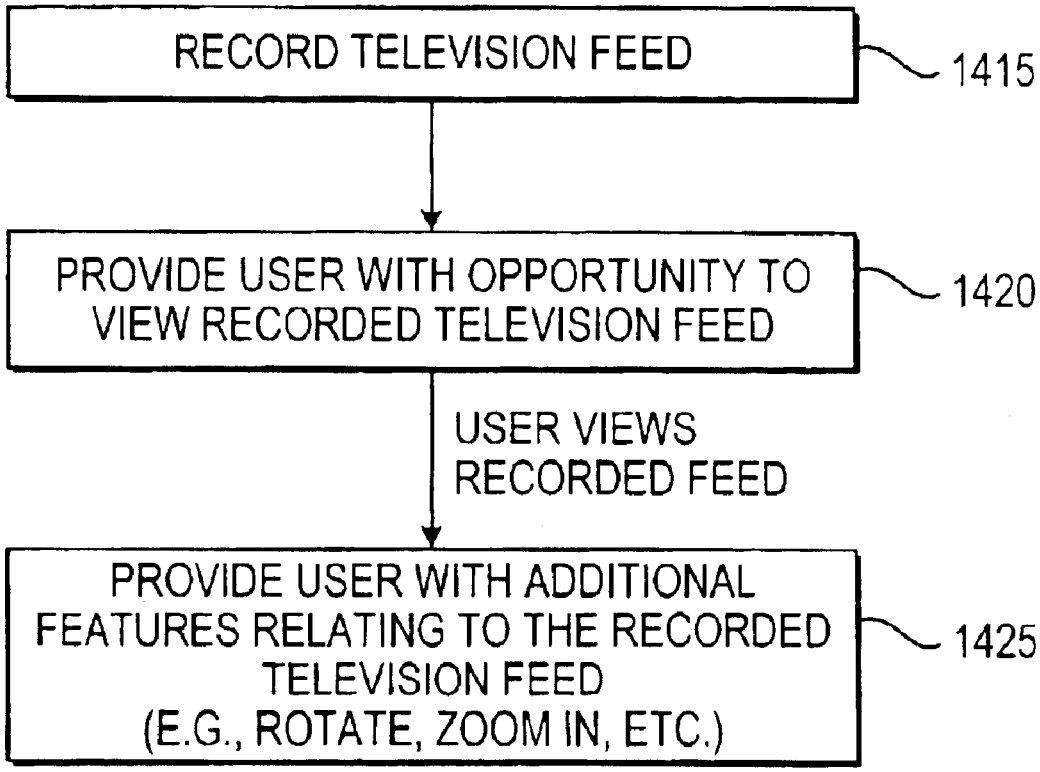
FIG. 16 is a flowchart of illustrative steps involved in recording a television feed in accordance with the present invention.

FIGS. 15 and 16 are flowcharts illustrating some of the steps involved in providing multiple feeds based on the user's wager information. Upon selecting prompt 802 (FIGS. 9 and 10) or "Build-a-Bet" option 1120 (FIG. 12), the user may create a wager with the interactive wagering application at step 1405. The user may be led through a series of screens 1500–2300 (FIGS. 17–25) to place a wager. Upon placing a wager, the user may be provided with a television feed corresponding to the user's wager at step 1410. For example, the set-top box may transmit the name of the user's selected horse to television distribution facilities 18. Television distribution facilities 18 may access a table that matches all horse names at all available races to appropriate specific television feeds. Television distribution facilities 18 may determine the corresponding television feed and provide the television feed to the user through user television equipment 22. The user's wager may include wager information, such as the horse, the racetrack, the type of wager, the total amount of the wager, the time of the race, etc.

In FIG. 16, some embodiments of the present invention may record television feeds so that a user may interact with the television feeds at any time subsequent to transmission as is possible at the time of transmission at step 1415. At step 1420, the user may be provided with an opportunity to view the recorded television feed. The television feed may be recorded automatically from, for example, television distribution facilities 18 or video production system 14. Television distribution facilities 18 or video production system 14 may record the selected television feed when transmitting the television feed to user television equipment 22. In another approach, the user may request that the television feed be recorded. For example, the set-top box may send an indication to television distribution facilities 18 or video production system 14 that the user desires to record the television feed. Any suitable approach or any suitable combination of approaches may be used.

At step 1425, the user may be provided with additional features such as the ability to successively play a segment of the recorded television feed at different vantage points. For example, the user may desire to view the crossing of the finish line from a different perspective.

It will be understood that the series of screens 1500–2300, as illustrated in FIGS. 17–25, are exemplary and that additional screens may be added and some of the screens may be omitted or modified. Interactive wagering using set-top box wagering interfaces are discussed in, for example, the above-mentioned Marshall et al. U.S. patent application Ser. No. 09/330,651, filed Jun. 11, 1999. As discussed, the present invention may provide a novice interface as illustrated in the Build-A-Bet mode shown in FIGS. 17–25.

Figure 17:
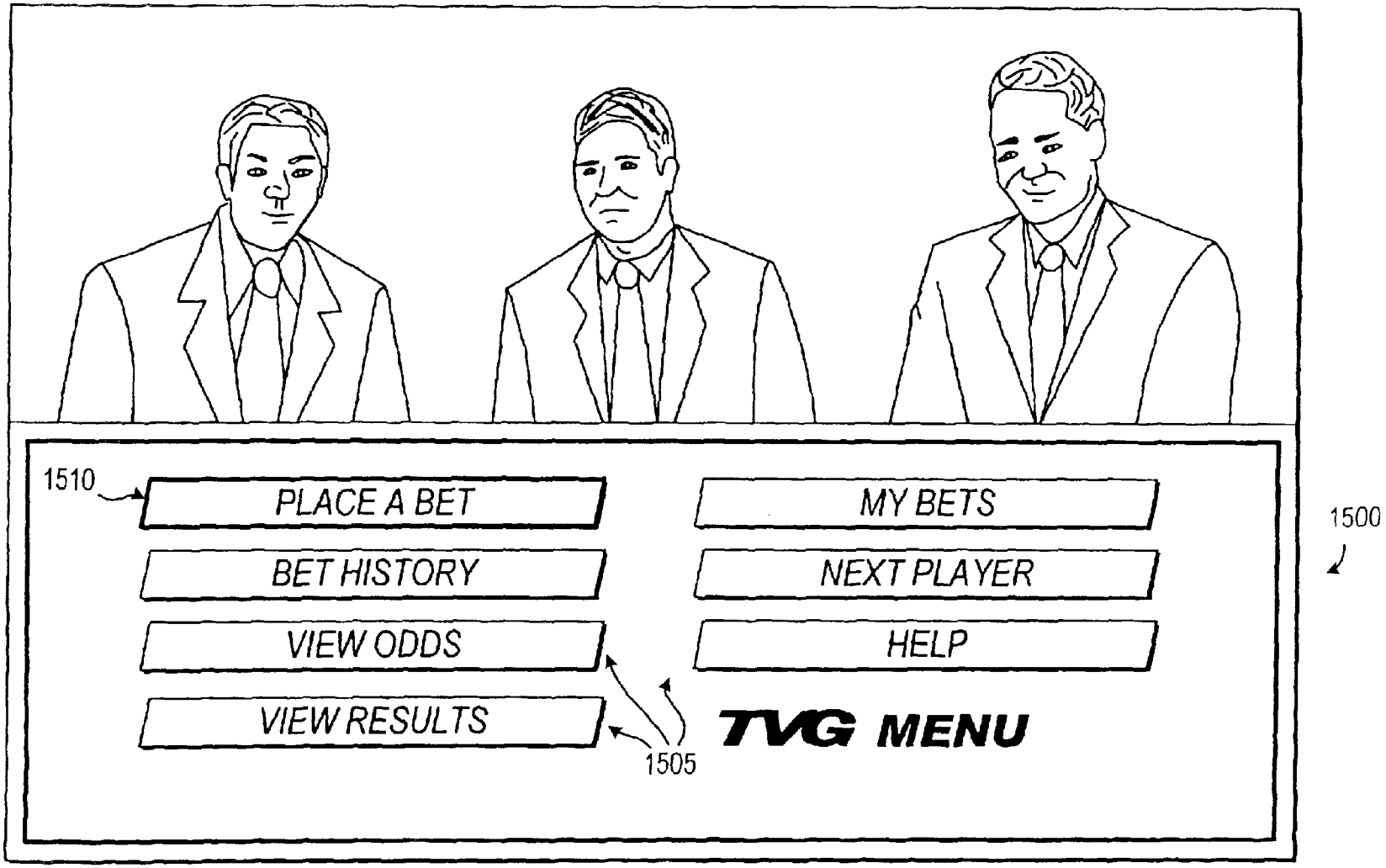
FIGS. 17–25 are illustrative screens for creating a wager suitable for use with the systems and methods of the present invention.

An illustrative menu screen 1500 that may be provided by the interactive wagering application is shown in FIG. 17. Screen 1500 and the screens shown in FIGS. 17–27 are examples of screens that may be displayed on a set-top box or other user television equipment 22. The format and contents of such screens may be modified to accommodate different platforms such as user computer equipment and user telephone equipment platforms if desired. Moreover, the information and options of the screens of FIGS. 17–27 may be provided using audio prompts to accommodate telephone-based wagering from touch-tone telephones.

As shown in FIG. 17, menu screen 1500 may include a number of different options. For example options may be provided to place a bet, to view a bet history, to view handicapping information such as odds, to view race results, to view a list of the user's wagers, to move to the next player (when multiple players are wagering at a single session), or to obtain help. Screen 1500 may be displayed as an overlay on top of a wagering-related television channel provided, for example, by video production system 14 of FIG. 1.

The user may make on-screen selections by using remote control keys or other suitable user interface to place a highlight region such as highlight region 1510 on top of a desired selection and pressing an OK or enter or select key on the remote control. As shown, the user has placed highlight region 1510 over the "Place a bet" option.

Figure 18:
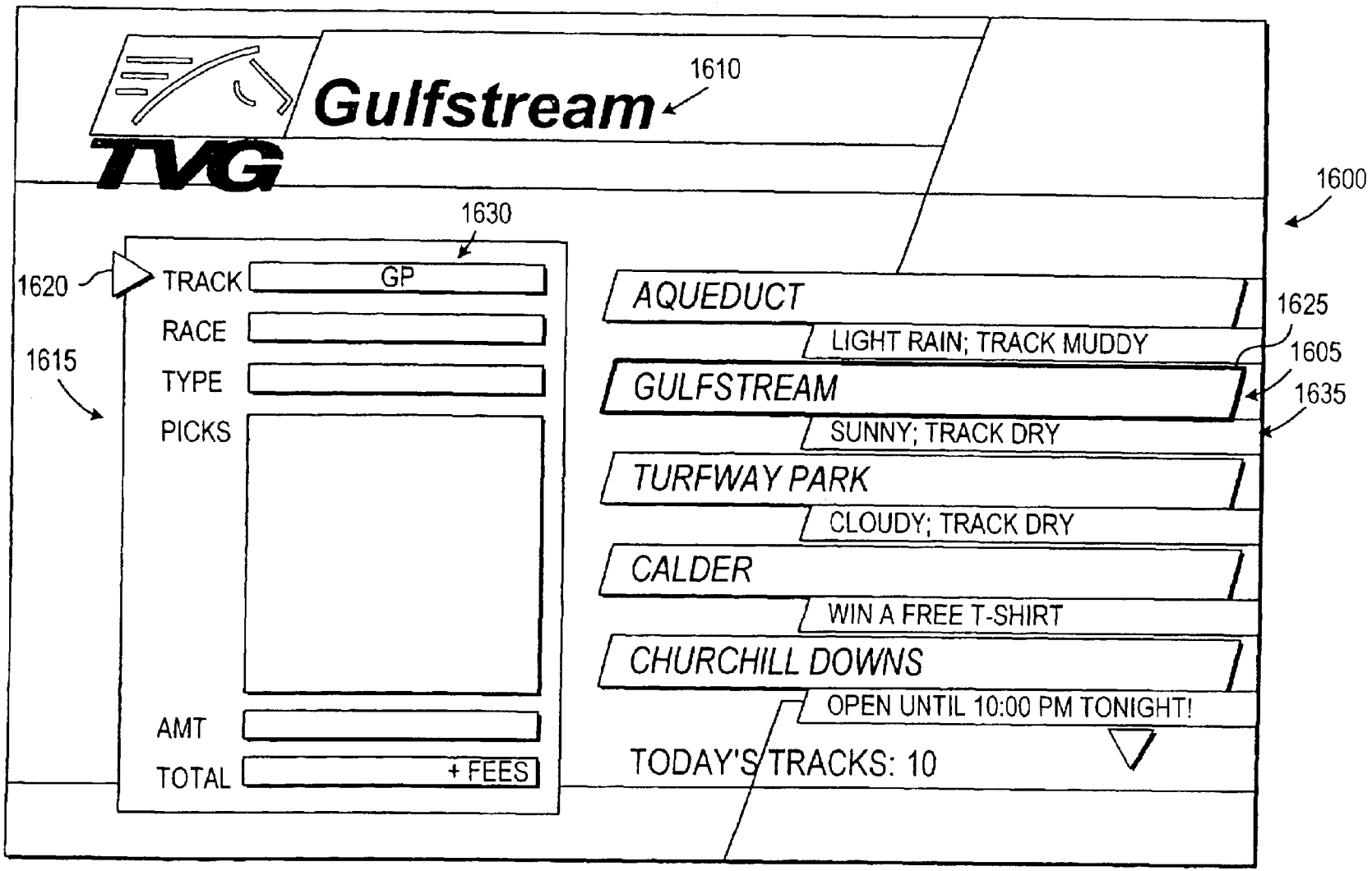

When the user selects the "Place a bet" option, the interactive wagering application may display a screen such as racetrack selection screen 1600 of FIG. 18. As shown in FIG. 18, the racetrack name field for each selectable racetrack option has a corresponding information area (e.g., information area 1635). In the example of FIG. 18, the content of information area 1635 (sunny; track dry) corresponds to the current weather and track conditions at the track listed in racetrack name field 1605 (Gulfstream). This provides the user with easily-accessible information on current track conditions before the user decides to place a wager at a particular track. Information areas may contain any other suitable information.

Screen 1600 may contain a wagering ticket 1615. Indicator 1620 may be used to visually indicate which portion of the wagering ticket 1615 is currently being filled in. In the example of FIG. 18, the user is selecting a desired racetrack for a wager. The user may select desired racetracks using highlight region 1625. When, for example, the user highlights the racetrack option for the Gulfstream track, the code 1640 for the Gulfstream track (GP) may be added to ticket 1615 and the name Gulfstream may be displayed in region 1610.

Figure 19:
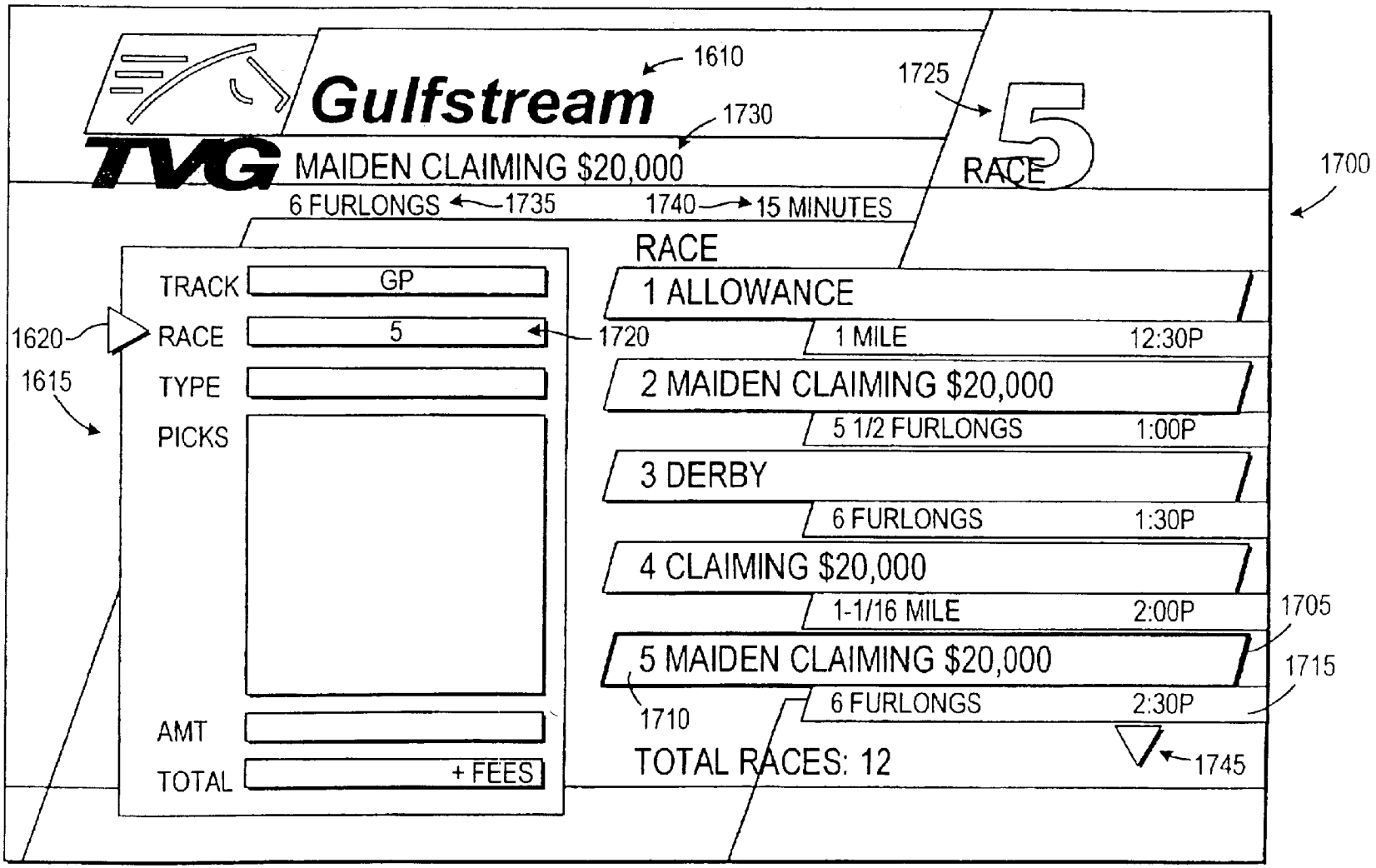

After the user has selected a track, the interactive wagering application may present a screen such as race selection screen 1700 of FIG. 19 to the user. In screen 1700, the user may move highlight region 1705 on top of a desired selectable race option. In the example of FIG. 19, the user has positioned highlight region 1705 on "Race 5." Race description field 1710 contains information describing "Race 5" (i.e., it is a maiden claiming race for $20,000). Information on various types of races may be included in the race description field for each race option. For example, information may be included in the race option that identifies the race as being an allowance race, a claiming race, a maiden claiming race, etc. Each race description field in screen 1700 has a corresponding information area. For example, race description field 1710 has corresponding information area 1715. The information areas may be used for any suitable content. For example, the information areas may contain information on the length of the race and the post time of the race. In the example of FIG. 19, "Race 5" is described in information area 1715 as being a race of 6 furlongs in length and having a post (start) time of 2:30 PM.

When the user highlights a desired race, the race number may be added to ticket 1615 in region 1720 and indicator 1620 may be positioned to make it clear the user is selecting a race. The race number for the currently highlighted race may be displayed in region 1725. The description of the race may be displayed in region 1730. The race length may be displayed in region 1735. The time until post (e.g., 15 minutes in the example of FIG. 19) may be displayed in region 1740. If desired, the user may scroll to additional races using, for example, a remote control down arrow key, as indicated by arrow 1745.

Figure 20:
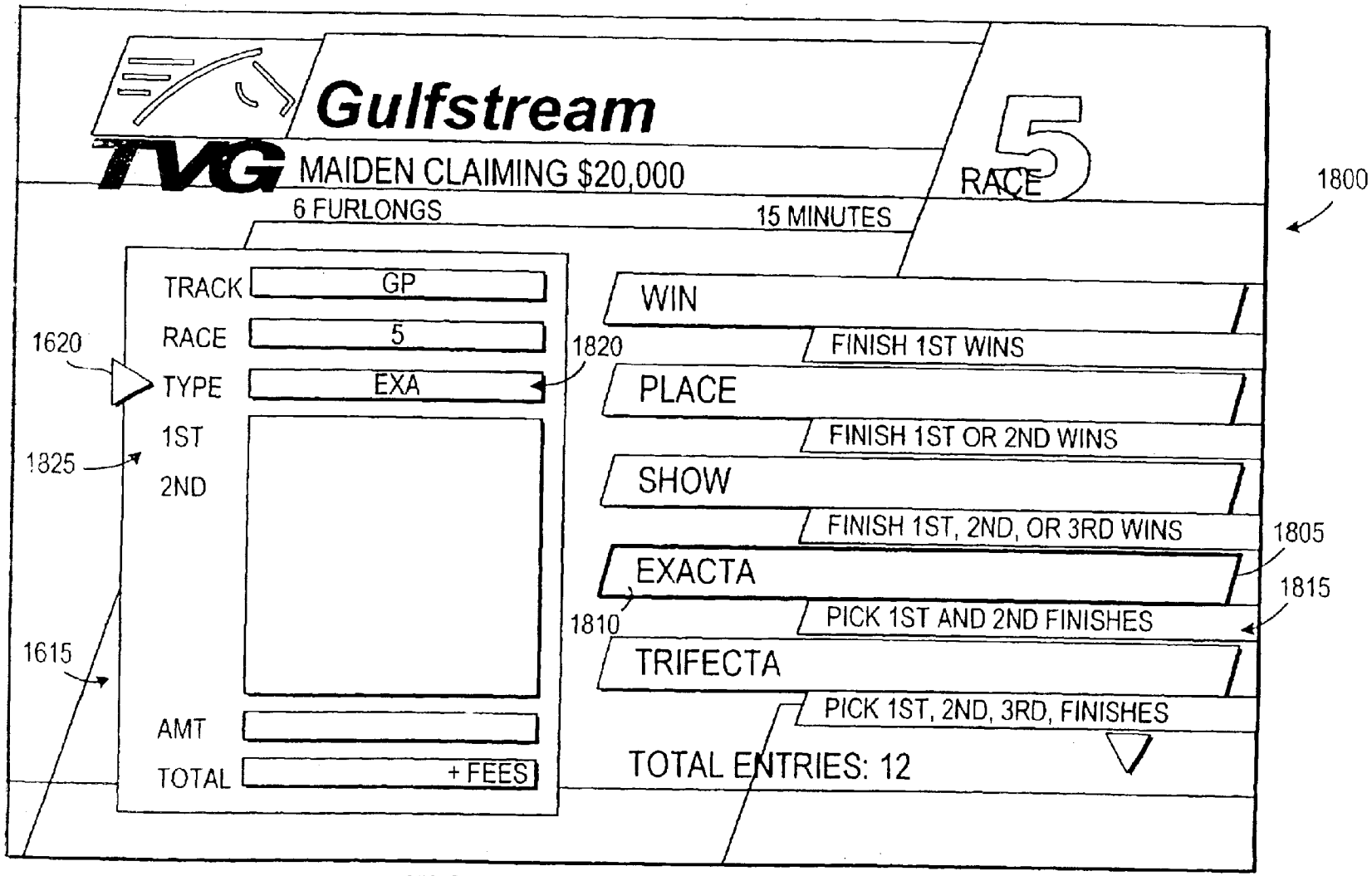

When the user selects a desired race, the interactive wagering application may display a wager type selection display such as screen 1800 of FIG. 20. The user may place highlight region 1805 on top of a desired selectable wager type option (e.g., win, place, show, exacta, trifecta, etc.). The wager types are listed in wager type fields such as wager type field 1810. The wager described in wager type field 1810 is an exacta. A corresponding information area may be provided for each wager type field. In the example of FIG. 18, wager type field 1810 (exacta) has a corresponding information area 1815. The information in information area 1815 is a wager type description for the corresponding wager type listed in wager type field 1810. If desired, other suitable information may be included in information areas such as information area 1815.

Wager ticket 1615 may be updated to reflect the highlighted wager type (exacta). This information is displayed in region 1820. Indicator 1620 may be moved to indicate that the user is selecting the wager type. Moreover, runner indicators 1825 may be provided. The number of runner indicators 1825 that are provided depends on the wager type. For a win wager, one runner indicator 1825 is displayed, because a win wager only involves a single runner. For an exacta wager (the subject of the example of FIG. 20), two runner indicators 1825 are displayed, one for the first place finisher and one for the second place finisher.

Figure 21:
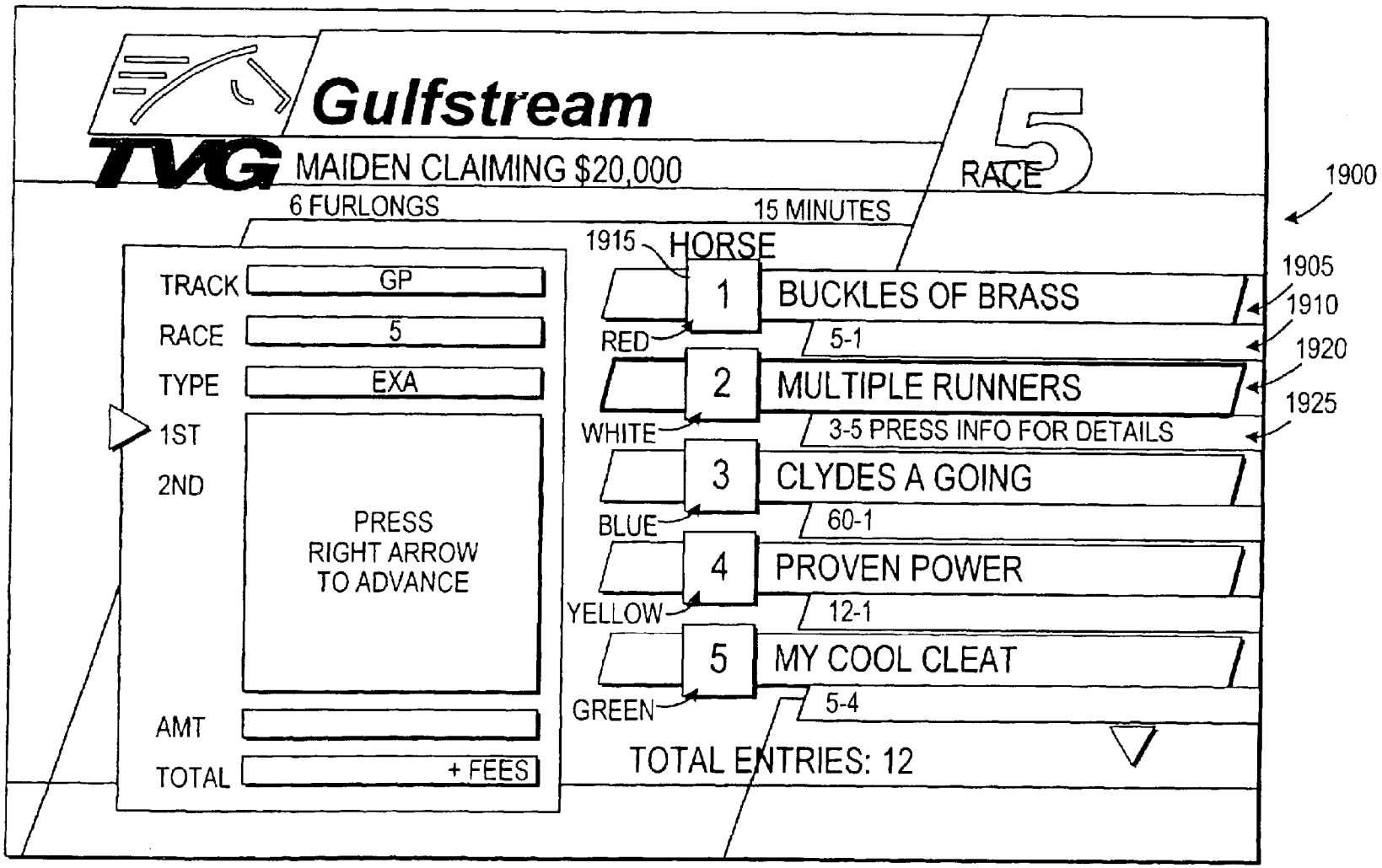
Figure 22:
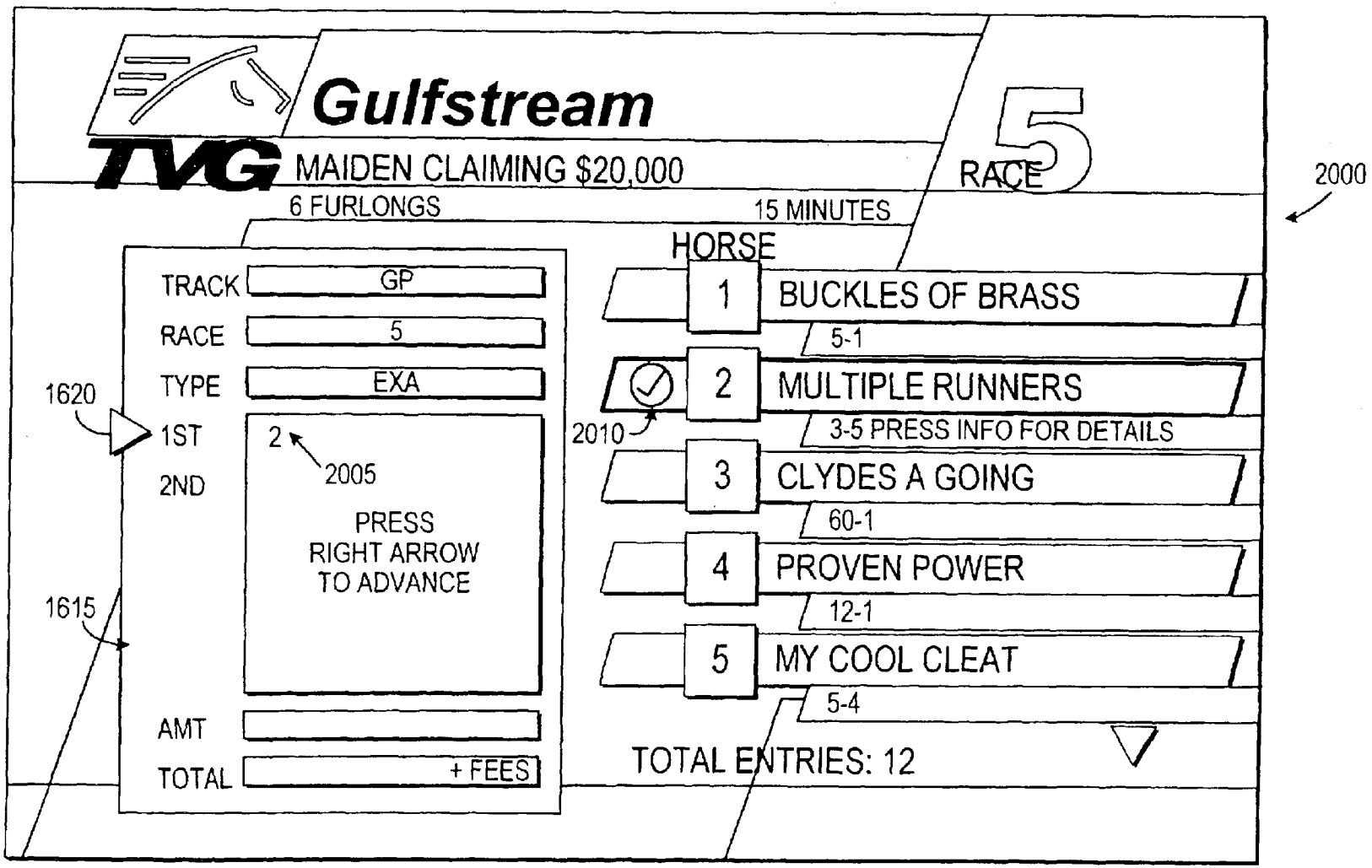

When the user selects the desired wager type, the interactive wagering application displays a horse selection display such as screen 1900 of FIG. 21. As shown in FIG. 21, the names of the horses are listed in selectable horse option name fields such as horse name field 1905 and corresponding information areas such as information area 1910 are used to display information on the current win odds for each horse. If desired, other information, such as information on the horse's jockey or trainer, etc. may also be provided in the information areas.

Horse numbers such as horse number 1915 are provided adjacent to each horse name. As shown in FIG. 21, each horse number may be a different color. In particular, each horse number may be displayed using the same colors that are used for that horse's saddle blankets in the actual race. The saddle blanket coloring convention is used to assist users in visually identifying their horse during a race, without being required to discern the individual runner numbers in the race video. Providing this information on the horse selection screen 1900 assists the user in remembering the proper colors for their horses.

If a betting interest involves more than one horse, there may be a horse number (e.g., horse number 2 in the example of FIG. 21) that has more than one associated runner. An indication 1920 (e.g., "multiple runners") may be displayed in the horse name field of the selectable horse option for such entries. Information instructing the user to press an info button or the like may be provided in the corresponding information area 1925.

After the user selects each horse, the wagering ticket is updated. If, for example, the user selects horse number 2, the interactive wagering application may display a screen such as screen 2000 of FIG. 22 in which wagering ticket 1615 has been updated to include information 2005 on the selected horse (i.e., horse number 2). Indicator 1620 points to the current runner position that is being selected (e.g., the first place finisher in the example of FIG. 22). In addition, an indicator such as check indicator 2010 may be provided to make it clear which horse has been selected.

Figure 23:
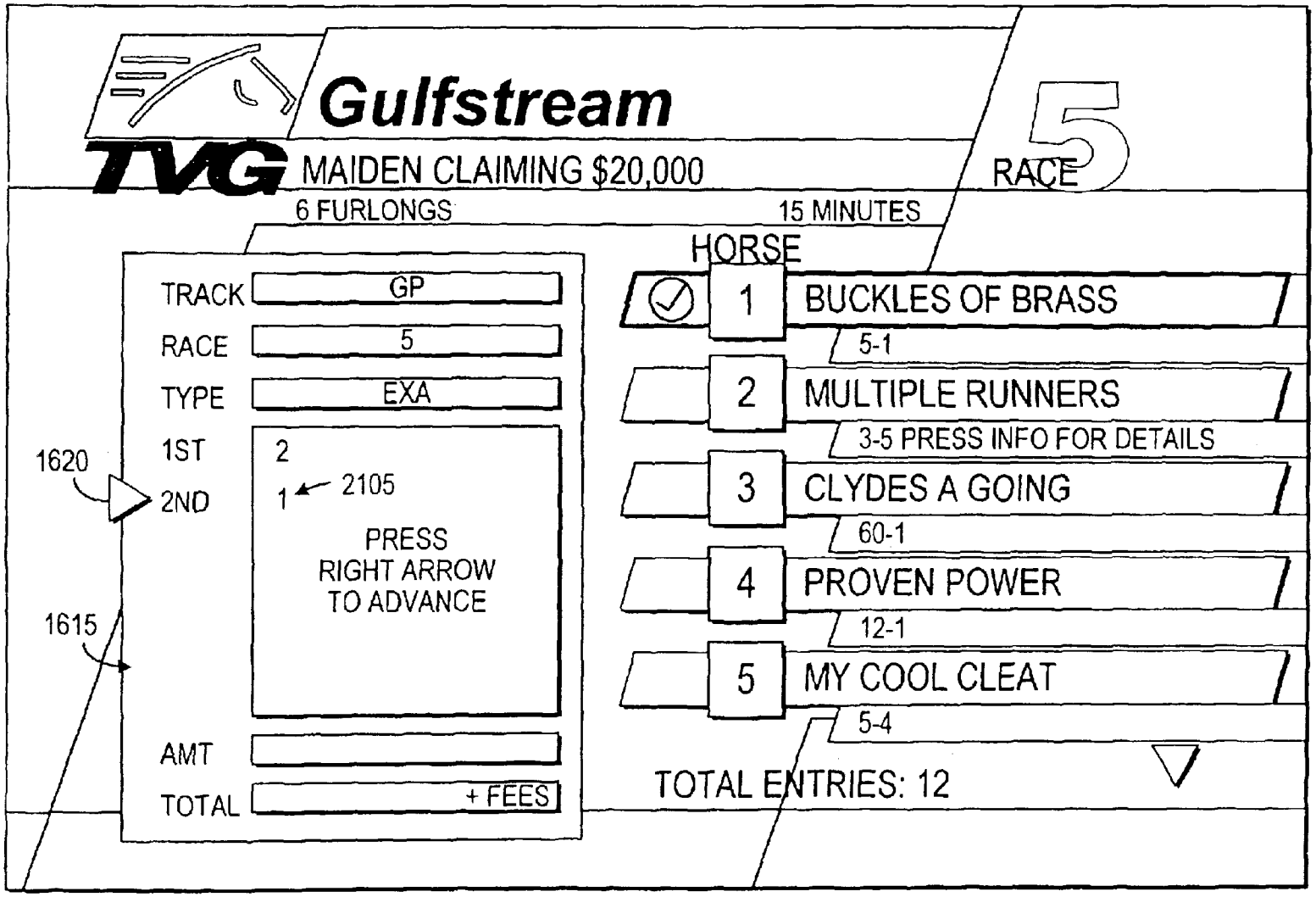

After the user selects a first place finisher, the user may select a second place finisher, as shown in FIG. 23. In the example of FIG. 23, the user has highlighted horse number 1 and this information 2105 is reflected in wager ticket 1615. The position of indicator 1620 may also be updated.

Although selecting a first and second place finisher completes an exacta wager, the user may wish to add additional runners to either the first or second place finisher slots. When the user has finished adding runners, the user may press a remote control right arrow key to move to the next screen, which may be indicated by, for example, an on-screen message. The interactive wagering application may then present the user with a wager amount selection screen such as wager amount selection screen 2200 of FIG. 24.

Figure 24:
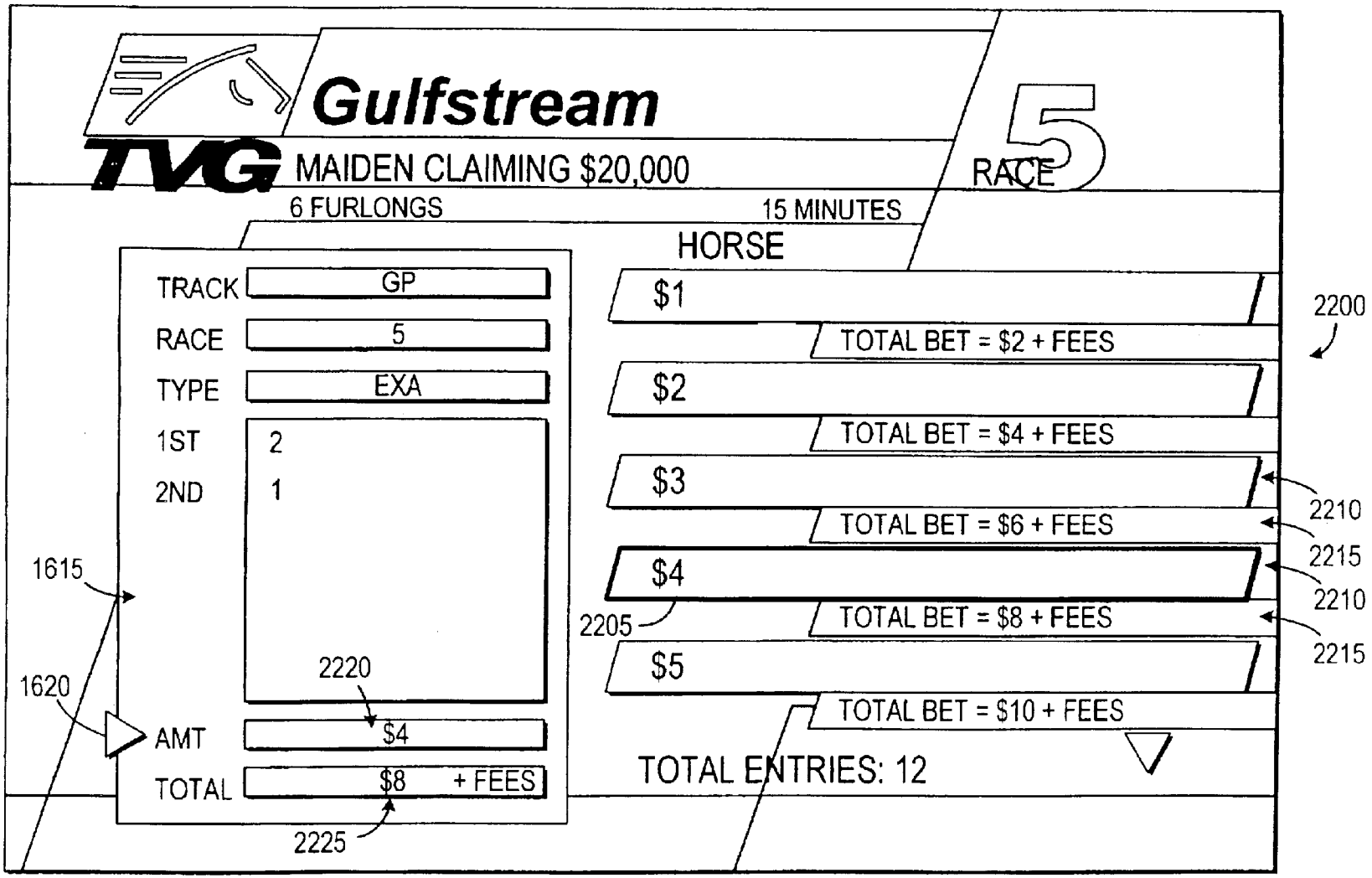

As shown in FIG. 24, screen 2200 may provide the user with an opportunity to select from various wager amounts. Highlight region 2205 may be used to highlight a desired wager amount option. There are a number of wager amount fields 2210, each containing a different wager amount. There is a corresponding information area 2215 for each wager amount field 2210. The interactive wagering application may display any suitable information in information areas 2215. In the example of FIG. 24, each information area 2215 contains the results of a calculation indicating how much the user's total wager would amount to after taking into account any multiple runner selection that the user has made. As an example, if the user selects a $4 wager amount by highlighting the wager amount field for $4 wagers as shown in FIG. 24, the total amount deducted from the user's account for the wager (not accounting for any possible winnings) will be $8. This is also reflected in wagering ticket 1615, in which the wager amount 2220 ($4) and the total amount being wagered 2225 ($8) are shown separately. The position of indicator 1620 may be updated to reflect that the user is selecting a wager amount.

Figure 25:
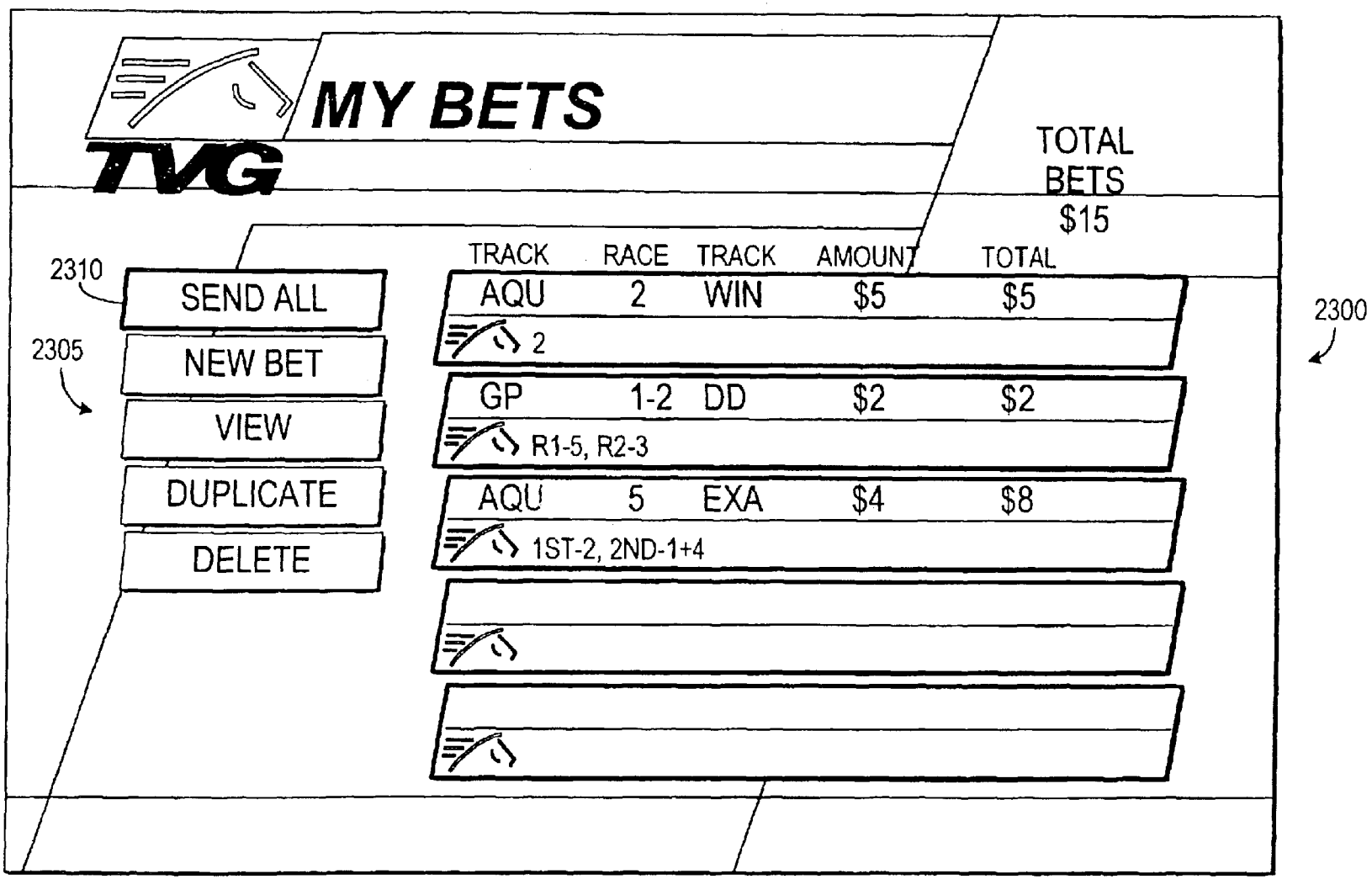

When the user has finished selecting a wager amount, the interactive wagering application may display, for example, screen 2300 of FIG. 25. Screen 2300 may list all of the wagers that the user has created but not placed. Options 2305 may be provided to allow the user to create a new wager, view wager details, duplicate a wager, and delete a wager. Options 2305 also include an option to send all created wagers. In the example of FIG. 25, the user has used highlight region 2310 to highlight the send all option. When the user selects the send all option, the wagers listed in screen 2300 are submitted to transaction processing and subscription management system 24 for processing.

Figure 26:
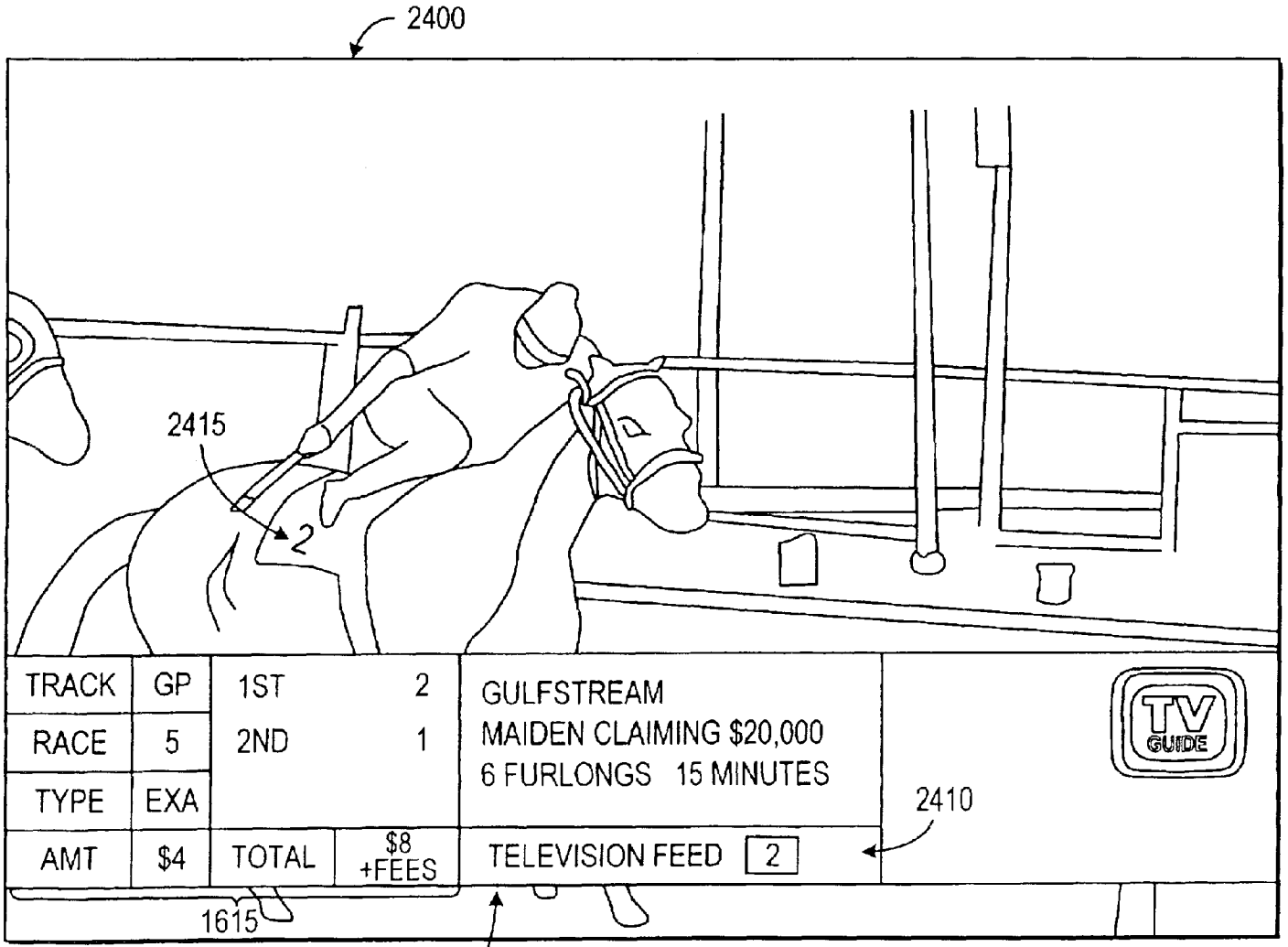
FIG. 26 is an illustrative screen with a television feed corresponding to the user's wager in accordance with the present invention.

As shown in FIG. 26, the user may be provided with a television feed, such as a video of racing coverage, corresponding to the user's wagering information. As shown in the example, the user is currently receiving television feed #2. Screen 2400 includes indicator bar 2405, which may include wagering ticket 1615 (as in FIGS. 18–24) and television feed number 2410. Wagering ticket 1615 may reflect the user's current wager and wager information. Television feed number 2410 may identify the television feed the user is currently receiving. In response to the user's wager, the user's television feed may correspond to the user's wagering information. For example, the user may be presented with television feeds corresponding to horse #2. In the television feed, horse number 2415 shows that the user is currently watching horse #2. In this example, the user placed a wager on horse #2 at Gulfstream. At the start of the race, the user may be presented with a view of horse #2 coming out of the gate (as shown in FIG. 26). After a predetermined amount of time, the user may be presented with an overhead view of horse #2 in relation with the other horses. Towards the conclusion of the race, the user may be presented with a view of horse #2 and the finish line. The corresponding feeds may give the user the feeling of being at the race.

Figure 27:
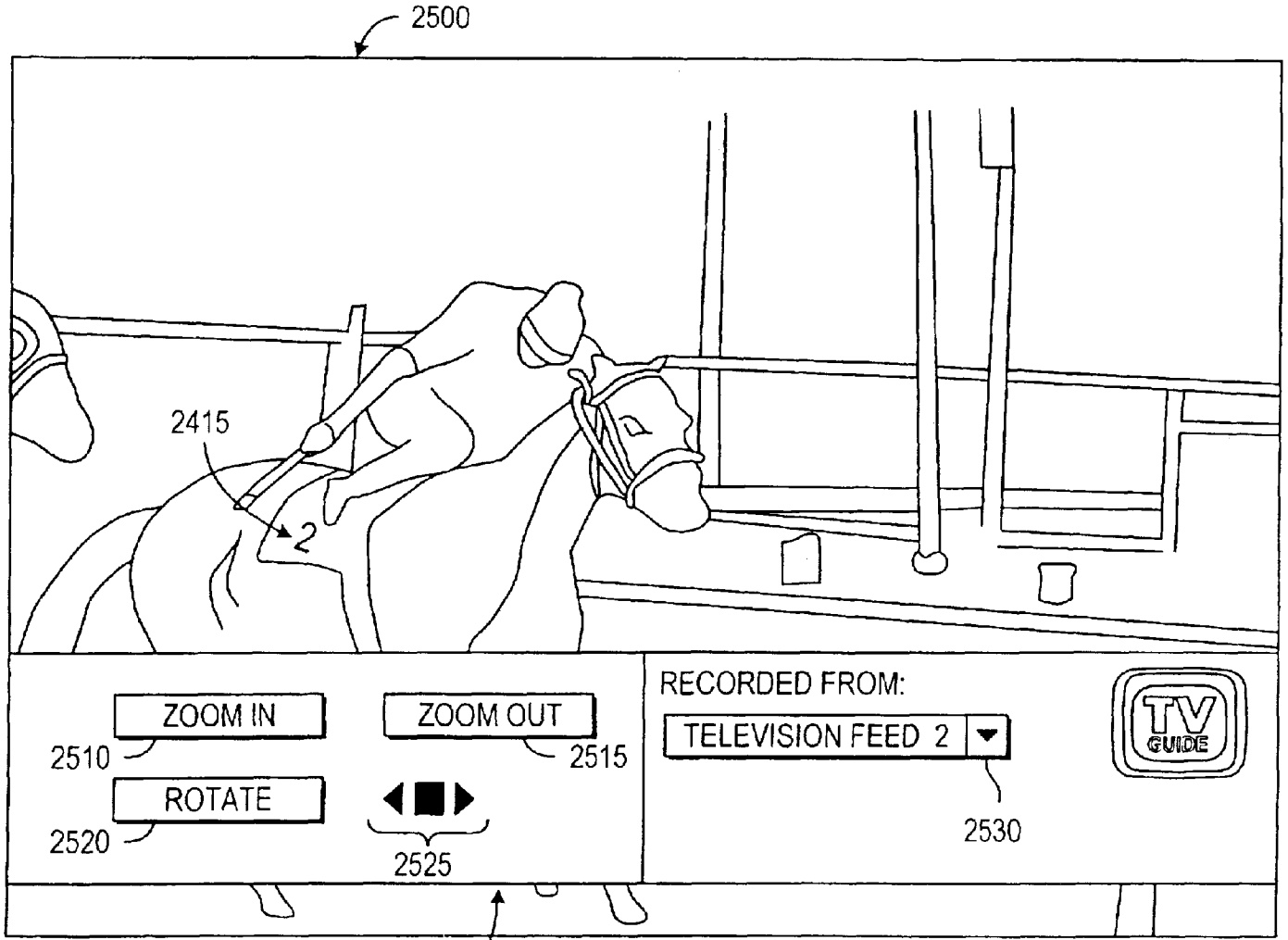
FIG. 27 is an illustrative screen that may present the user with additional features relating to the recorded television feed in accordance with the present invention.

Some embodiments of the present invention may record a television feed so that a user may interact with the television feeds at any time subsequent to transmission as is possible at the time of transmission. As shown in FIG. 27, the user may be provided with recorded television feed of the portion of the race shown in FIG. 26. The user may be provided with additional features such as the ability to successively play a segment of the recorded television feed at different vantage points. Screen 2500 includes indicator bar 2505, which may include user-selectable options. Options may include "zoom in" button 2510, "zoom out" button 2515, "rotate" button 2520, and control buttons 2525. "Zoom in" button 2510 and "zoom out" button 2515 allow the user to alter the magnification of the objects in screen 2500. "Rotate" button 2520 allows the user to view the objects in screen 2500 from a different perspective. For example, the user may desire to view the crossing of the finish line from a different perspective. Control buttons 2525 allow the user to, for example, fast forward or rewind the recorded feed. Display 2500 may also include a television feed menu 2530. Menu 2530 may provide the user with an opportunity to choose any of the recorded television feeds. Display 2500 may also include the name of the race or the name of horse.

Although the displays shown that may be presented to the user have sometimes been described as having been generated by a set-top box or the like, these displays may be generated by any suitable user equipment including user computer equipment, such as a notebook or handheld computer, a cellular telephone with a display, or any other suitable device.

Figure 28:
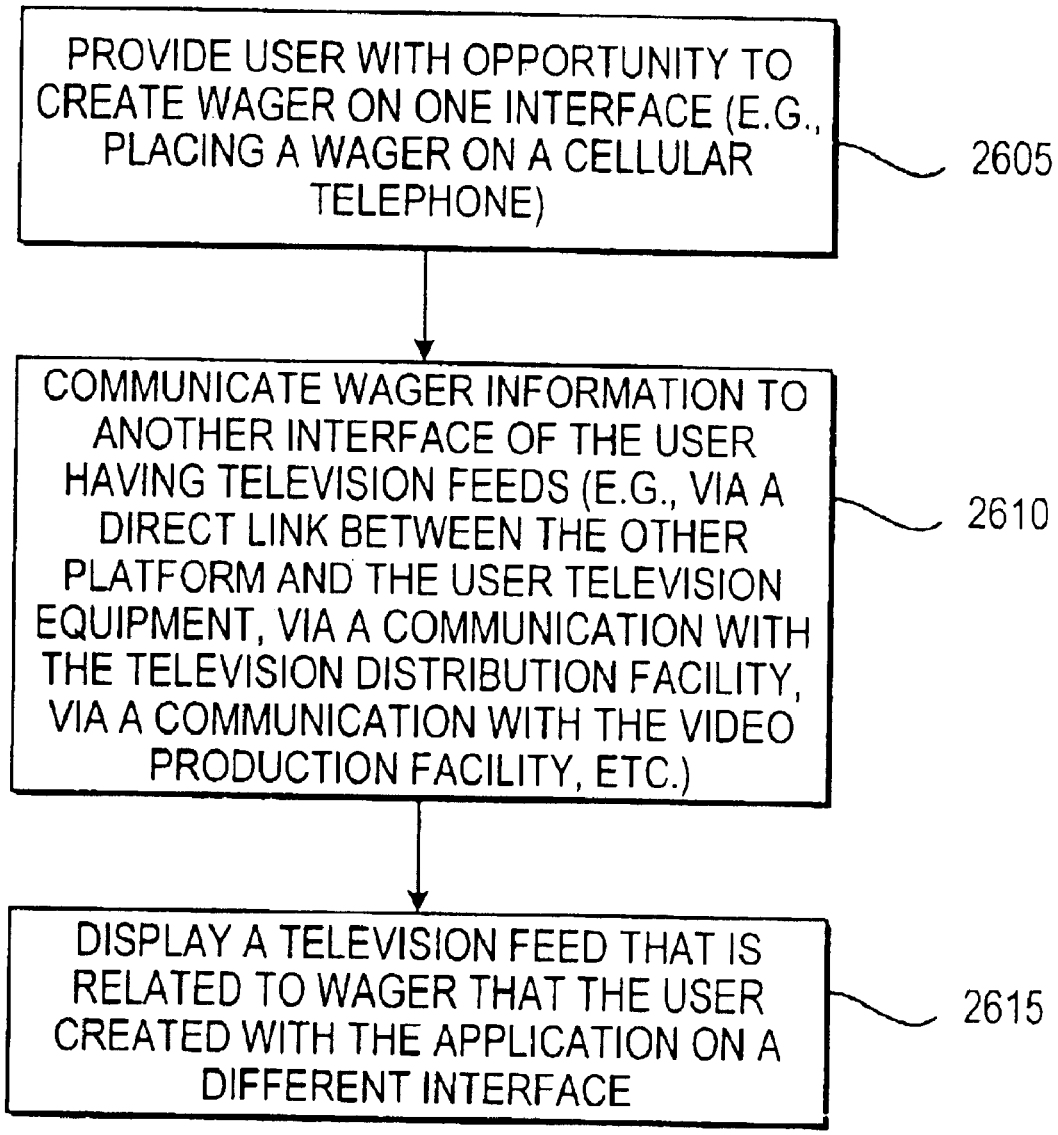
FIG. 28 is a flowchart of illustrative steps involved in providing wagering services through more that one wagering interface in accordance with the present invention.

FIG. 28 is a flowchart of illustrative steps involved in providing wagering services through more that one wagering interface. In some embodiments, wagering services may be provided through more that one wagering interface (user telephone equipment 32, user television equipment 22, user computer equipment 20, etc.) at step 2605. For example, the user may create a wager using a cellular telephone.

At step 2610, information about the wager may be communicated to another wagering interface of the user, such as user television equipment 22 (e.g., a set-top box). For example, the cellular telephone may send a communication to transaction processing and subscription management system 24, which may send the user's wager information to television distribution facilities 18. Television distribution facilities 18 may send the user's wager information to user television equipment 22 and, for example, inform the set-top box of the wager. When user television equipment 22 receives the user's wager, user television equipment 22 may select a television feed corresponding to the user's wager. At step 2615, in response, a television feed that is related to the wager that the user created with the application on the one interface may be presented (e.g., automatically presented) to the user on the other interface having the television feeds.

Thus, interactive wagering systems and methods for providing multiple television feeds relating to wagering events based upon a user's selection when using an interactive wagering interface are provided. It will be understood that the foregoing is merely illustrative of the principles of this invention and that various modifications can be made by those skilled in the art without departing from the scope and spirit of the invention, which is limited only by the claims that follow.

What is claimed is:

1. A method for viewing races using an interactive wagering application, the method comprising:

providing a user with an opportunity to create a wager for a race with the interactive wagering application;

providing two camera views for the race with the interactive wagering application, wherein the two camera views are different camera views of the race;

automatically selecting one of the two camera views for the race based at least in part on the wager; and displaying the automatically selected camera view for the race.

2. The method defined in claim 1 wherein the wager contains wager information.

3. The method defined in claim 2 wherein wager information comprises information selected from the group consisting of the race, a horse, a jockey, a horse number, a jockey color, a horse color, a horse name, a racetrack, a type of wager, a total amount of wager, and a time of the race.

4. The method defined in claim 1 wherein the two camera views are provided from a television feed.

5. The method defined in claim 1 wherein the two camera views are provided from a plurality of television feeds.

6. The method defined in claim 5 further comprising identifying a television feed of the plurality of television feeds that is providing the selected camera view.

7. The method defined in claim 1 further comprising providing the user with an opportunity to change to a different perspective of the race from the selected camera view.

8. The method defined in claim 7 wherein providing the user with an opportunity to change to a different perspective further comprises providing a camera option, wherein the camera option is selected from the group consisting of zoom in, zoom out, and rotate.

9. The method defined in claim 1 further comprising providing the user with an opportunity to change from the automatically selected camera view to another camera view.

10. The method defined in claim 1 further comprising automatically changing the perspective of the selected camera view based at least in part on the race.

11. The method defined in claim 1 further comprising automatically changing the selected camera view to another camera view based at least in part on the race.

12. The method defined in claim 1 further comprising recording the selected camera view.

13. The method defined in claim 12 wherein recording the selected camera view further comprises providing the user with an opportunity to view the recorded camera view.

14. The method defined in claim 1 further comprising recording the two camera views.

15. The method defined in claim 14 wherein recording the two camera views further comprises providing the user with an opportunity to view the recorded camera views.

16. The method defined in claim 14 wherein recording the selected camera view further comprises providing the user with an opportunity to search through the recorded camera views.

17. An interactive wagering system for viewing races using an interactive wagering application, the system comprising:

user equipment with which the interactive wagering application is implemented, wherein the user equipment is configured to:

provide a user with an opportunity to create a wager for a race with the interactive wagering application;

provide two camera views for the race with the interactive wagering application, wherein the two camera views are different camera views of the race;

automatically select one of the two camera views for the race based at least in part on the wager; and display the automatically selected camera view for the race.

18. The system defined in claim 17 wherein the wager contains wager information.

19. The system defined in claim 18 wherein wager information comprises information selected from the group consisting of the race, a horse, a jockey, a horse number, a jockey color, a horse color, a horse name, a racetrack, a type of wager, a total amount of wager, and a time of the race.

20. The system defined in claim 17 wherein the two camera views are provided from a television feed.

21. The system defined in claim 17 wherein the two camera views are provided from a plurality of television feeds.

22. The system defined in claim 21 wherein the user equipment is further configured to identify a television feed of the plurality of television feeds that is providing the selected camera view.

23. The system defined in claim 17 wherein the user equipment is further configured to provide the user with an opportunity to change to a different perspective of the race from the selected camera view.

24. The system defined in claim 23 wherein the user equipment is further configured to provide a camera option, wherein the camera option is selected from the group consisting of zoom in, zoom out, and rotate.

25. The system defined in claim 17 wherein the user equipment is further configured to provide the user with an opportunity to change from the automatically selected camera view to another camera view.

26. The system defined in claim 17 wherein the user equipment is further configured to automatically change the perspective of the selected camera view based at least in part on the race.

27. The system defined in claim 17 wherein the user equipment is further configured to automatically change the selected camera view to another camera view based at least in part on the race.

28. The system defined in claim 17 wherein the user equipment is further configured to record the selected camera view.

29. The system defined in claim 28 wherein the user equipment is further configured to provide the user with an opportunity to view the recorded camera view.

30. The system defined in claim 17 wherein the user equipment is further configured to record the two camera views.

31. The system defined in claim 30 wherein the user equipment is further configured to provide the user with an opportunity to view the recorded camera views.

32. The system defined in claim 30 wherein the user equipment is further configured to provide the user with an opportunity to search through the recorded camera views.

33. A machine-readable medium for use in allowing a user of an interactive wagering system to view races, comprising machine program logic recorded thereon for:

providing the user with an opportunity to create a wager for a race;

providing two camera views for the race, wherein the two camera views are different camera views of the race;

automatically selecting one of the two camera views for the race based at least in part on the wager; and displaying the automatically selected camera view for the race.

34. The machine-readable medium defined in claim 33 wherein the wager contains wager information.

35. The machine-readable medium defined in claim 34 wherein wager information comprises information selected from the group consisting of the race, a horse, a jockey, a horse number, a jockey color, a horse color, a horse name, a racetrack, a type of wager, a total amount of wager, and a time of the race.

36. The machine-readable medium defined in claim 33 wherein the two camera views are provided from a television feed.

37. The machine-readable medium defined in claim 33 wherein the two camera views are provided from a plurality of television feeds.

38. The machine-readable medium defined in claim 37 further comprising machine program logic recorded thereon for identifying a television feed of the plurality of television feeds that is providing the selected camera view.

39. The machine-readable medium defined in claim 33 further comprising machine program logic recorded thereon for providing the user with an opportunity to change to a different perspective of the race from the selected camera view.

40. The machine-readable medium defined in claim 39 further comprising machine program logic recorded thereon for providing a camera option, wherein the camera option is selected from the group consisting of zoom in, zoom out, and rotate.

41. The machine-readable medium defined in claim 33 further comprising machine program logic recorded thereon for providing the user with an opportunity to change from the automatically selected camera view to another camera view.

42. The machine-readable medium defined in claim 33 further comprising machine program logic recorded thereon for automatically changing the perspective of the selected camera view based at least in part on the race.

43. The machine-readable medium defined in claim 33 further comprising machine program logic recorded thereon for automatically changing the selected camera view to another camera view based at least in part on the race.

44. The machine-readable medium defined in claim 33 further comprising machine program logic recorded thereon for recording the selected camera view.

45. The machine-readable medium defined in claim 44 further comprising machine program logic recorded thereon for providing the user with an opportunity to view the recorded camera view.

46. The machine-readable medium defined in claim 33 further comprising machine program logic recorded thereon for recording the two camera views.

47. The machine-readable medium defined in claim 46 further comprising machine program logic recorded thereon for providing the user with an opportunity to view the recorded camera views.

48. The machine-readable medium defined in claim 46 further comprising machine program logic recorded thereon for providing the user with an opportunity to search through the recorded camera views.

49. An interactive wagering system for viewing races using an interactive wagering application, the system comprising:

means for providing a user with an opportunity to create a wager for a race with the interactive wagering application;

means for providing two camera views for the race with the interactive wagering application, wherein the two camera views are different camera views of the race;

means for automatically selecting one of the two camera views for the race based at least in part on the wager; and means for displaying the automatically selected camera view for the race.

50. The system defined in claim 49 wherein the wager contains wager information.

51. The system defined in claim 50 wherein wager information comprises information selected from the group consisting of the race, a horse, a jockey, a horse number, a jockey color, a horse color, a horse name, a racetrack, a type of wager, a total amount of wager, and a time of the race.

52. The system defined in claim 49 wherein the two camera views are provided from a television feed.

53. The system defined in claim 49 wherein the two camera views are provided from a plurality of television feeds.

54. The system defined in claim 53 further comprising means for identifying a television feed of the plurality of television feeds that is providing the selected camera view.

55. The system defined in claim 49 further comprising means for providing the user with an opportunity to change to a different perspective of the race from the selected camera view.

56. The system defined in claim 55 wherein the means for providing the user with an opportunity to change to a different perspective further comprises means for providing a camera option, wherein the camera option is selected from the group consisting of zoom in, zoom out, and rotate.

57. The system defined in claim 49 further comprising means for providing the user with an opportunity to change from the automatically selected camera view to another camera view.

58. The system defined in claim 49 further comprising means for automatically changing the perspective of the selected camera view based at least in part on the race.

59. The system defined in claim 49 further comprising means for automatically changing the selected camera view to another camera view based at least in part on the race.

60. The system defined in claim 49 further comprising means for recording the selected camera view.

61. The system defined in claim 49 wherein the means for recording the selected camera view further comprises means for providing the user with an opportunity to view the recorded camera view.

62. The system defined in claim 49 further comprising means for recording the two camera views.

63. The system defined in claim 49 wherein the means for recording the two camera views further comprises means for providing the user with an opportunity to view the recorded camera views.

64. The system defined in claim 49 wherein the means for recording the selected camera view further comprises means for providing the user with an opportunity to search through the recorded camera views.

* * * * *